US006946595B2

(12) United States Patent
Tamura et al.

(10) Patent No.: US 6,946,595 B2
(45) Date of Patent: Sep. 20, 2005

(54) PERFORMANCE DATA PROCESSING AND TONE SIGNAL SYNTHESIZING METHODS AND APPARATUS

(75) Inventors: Motoichi Tamura, Hamamatsu (JP); Yasuyuki Umeyama, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 238 days.

(21) Appl. No.: 10/635,995

(22) Filed: Aug. 7, 2003

(65) Prior Publication Data

US 2004/0035284 A1 Feb. 26, 2004

(30) Foreign Application Priority Data

Aug. 8, 2002 (JP) ..... 2002-231559
Aug. 8, 2002 (JP) ..... 2002-231560

(51) Int. Cl.[7] ..... G10H 1/02
(52) U.S. Cl. ..... 84/629; 84/615
(58) Field of Search ..... 84/600–603, 609, 84/615, 622–627, 629, 645, 649, 653, 662, 659, 660

(56) References Cited

U.S. PATENT DOCUMENTS 4,622,877 A 11/1986 Strong ..... 84/604
5,741,992 A 4/1998 Nagata ..... 84/631
5,770,812 A * 6/1998 Kitayama ..... 84/603
5,824,935 A 10/1998 Tanaka ..... 84/631
5,922,982 A * 7/1999 Ishibashi ..... 84/615
5,998,725 A * 12/1999 Ohta ..... 84/627
6,150,598 A * 11/2000 Suzuki et al. ..... 84/603

FOREIGN PATENT DOCUMENTS

EP 0690434 1/1996
JP 08-160951 6/1996

* cited by examiner

*Primary Examiner*—David Martin
*Assistant Examiner*—Jianchun Qin
(74) *Attorney, Agent, or Firm*—Pillsbury Winthrop Shaw Pittman LLP

(57) ABSTRACT

Each time a predetermined type of note controlling performance data (e.g., note-on event data) is detected from among a series of performance data, deviation values for a plurality of channels, varying in deviation state among the channels, are set such that a control value of a predetermined tone characteristic (e.g., event generation timing), included in the note controlling performance data, is caused to vary among the plurality of channels. Then, values, obtained by causing the control value vary among the plurality of channels in accordance with the respective deviation values of the channels, are set as new control values for the corresponding channels. Then, for each of the channels, there is created note controlling performance data of the predetermined type having the corresponding new control value incorporated therein. A break of a phrase in performance data may be detected so that control can be performed per phrase.

31 Claims, 12 Drawing Sheets

PERFORMANCE DATA PROCESSING AND TONE SIGNAL SYNTHESIZING METHODS AND APPARATUS

BACKGROUND OF THE INVENTION

The present invention relates to the field of electronic musical instruments, and more particularly to an improved performance data processing method, performance data processing program, performance data processing apparatus and tone signal synthesizing method for imparting performance data with an ensemble feeling.

In cases where an ensemble performance (session) is executed using acoustic musical instruments, tones performed by individual players can not be exactly the same even if all the players use musical instruments of a same type to perform a same music piece.

Performance styles and feelings of individual players would vary depending on their character and performing tendency (hereinafter referred to simply as "character" or "individuality"). Also, the acoustic musical instruments used by the individual players would have acoustic characteristics differing subtly therebetween. As a consequence, tones generated by the musical instruments would be imparted with an ensemble feeling.

In the field of electronic musical instruments, there have been employed various schemes or techniques to produce such an ensemble feeling in, for example, live keyboard performance or music piece production carried out by manually inputting musical notes to a sequencer.

First one of the techniques for producing such an ensemble feeling is "detune", where tones of a plurality of elements are simultaneously generated in response to designation of a tone color (voice). In this case, the tones of the individual elements would be generated at slightly different pitches, so that, even when a note-on message of a single note is input, there can be imparted an effect as if a plurality of tones were being generated simultaneously. However, here, settings of the individual elements are merely differentiated from each other uniformly, so that an amount of detune would be the same for all tones generated. Therefore, this first technique would present the problem that it is unable to produce such a feeling of variation as produced by an ensemble performance of acoustic musical instruments.

Second one of the techniques for producing such an ensemble feeling uses a voice called a "section tone". According this technique, an ensemble performance by a plurality of musical instruments is sampled in advance to provide original waveforms for a waveform memory tone generator. For example, if a section tone "strings" is selected in a "strings" tone color section, there can be obtained sounds of realistic atmosphere having an ensemble feeling. However, because this technique performs various tone generator control uniformly on unseparably-synthesized section tones, output tones tend to be very monotonous and unnatural. Further, although there are user's needs for various section tones, such as those of strings, brass and human voices, these section tones can not be realized unless they are provided in advance in the tone generator.

Third one of the techniques for producing such an ensemble feeling is one that creates and uses as many performance data of a plurality of solo voices (tone colors of separate musical instruments) as necessary. Fourth one of the techniques is one that uses in combination the voices provided by the above-mentioned second and third techniques.

The above-mentioned third and fourth techniques may enhance a capability to provide desired sounds by variously combining the voices. However, to attain an ensemble feeling, sequence data have to be prepared for each of the voices and adjusted appropriately through trial and error, which would require complicated and troublesome setting operation. Further, the third and fourth techniques are only applicable to cases where notes are manually entered, and they can not deal with real-time performances on keyboards etc.

In addition to the aforementioned problems in attaining an ensemble feeling, there has been demands that expression reflecting character and performing tendencies of the players be effectively and easily imparted to individual performances in an ensemble performance and that such expression reflecting character and performing tendency of the player be effectively and easily imparted to even a solo performance.

SUMMARY OF THE INVENTION

In view of the foregoing, it is an object of the present invention to provide an improved performance data processing method, performance data processing program, performance data processing apparatus and tone signal synthesizing method which process input performance data in such a manner as to synthesize tone signals with an ensemble feeling. For example, the present invention seeks to provide a technique for processing performance data to impart variation to note-on timing and thereby permit synthesis of tone signals having an ensemble feeling.

It is another object of the present invention to provide an improved performance data processing method, performance data processing program, performance data processing apparatus and tone signal synthesizing method which process input performance data in such a manner as to synthesize tone signals having unique expression. For example, the present invention seeks to provide a technique for processing performance to impart variation to note-on timing and thereby permit synthesis of tone signals having unique expression.

In order to accomplish the above-mentioned objects, the present invention provides a performance data processing method, which comprises: a step of receiving a series of performance data; a detection step of detecting a predetermined type of note controlling performance data from among the received series of performance data, the predetermined type of note controlling performance data including a control value of a predetermined tone characteristic of a note; a setting step of, each time the predetermined type of note controlling performance data is detected, setting deviation values for a plurality of channels presenting mutually different deviation states, i.e., value deviating states, or deviation patterns, in order to cause the control value of the predetermined tone characteristic of the note to vary among the channels each time the predetermined type of note controlling performance data is detected; and a generation step of, each time the predetermined type of note controlling performance data is detected, causing the control value of the predetermined tone characteristic of the note, included in the detected predetermined type of note controlling performance data, to vary among the plurality of channels in accordance with the respective deviation values of the channels, set by the setting step, so as to obtain channel-specific control values, and generating, for the individual channels, the channel-specific control values as new control values of the predetermined tone characteristic of the note.

In this manner, note controlling performance data of the predetermined type having new control values of the predetermined tone characteristic of the note, generated by the generation step, are created for the plurality of channels.

With the arrangements, the present invention can cause a predetermined tone characteristic of a note, constituting performance data, to vary among the channels each time predetermined type of note controlling performance data is detected, and create note controlling performance data for a plurality of channels which include their respective control values (channel-specific control values) presenting mutually different deviation states or deviation patterns. Tone generator device, arranged to generate tone signals on the basis of the thus-created performance data, can synthesize tone signals with an ensemble feeing as if a plurality of players were executing an actual ensemble performance, by performing waveform synthesis on the channel-by-channel basis while imparting such different deviations to the predetermined tone characteristic of the note constituting the performance data. Thus, the present invention can achieve natural tone control as compared to the conventional technique where tone signals for a plurality of players are unseparable as in the case of conventional "section" tones. Further, even where no "section" tone is prepared in advance, the present invention can appropriately impart an ensemble feeling to any tone color to which the user desires to impart an ensemble feeling. Because the present invention can eliminate a need for the user to create performance data for a plurality of players, it can not only readily afford an ensemble effect but also appropriately deal with a real-time performance.

As an example, the predetermined tone characteristic of the note is note-on timing to start tone generation of the note. Variation in note-on timing can greatly contribute to an ensemble feeling. Thus, the present invention can output performance data that can be suitably used to synthesize tone signals having an ensemble feeling.

As an example, the predetermined tone characteristic of the note is delay vibrato start timing. Variation in delay vibrato start timing to be applied to tone signals of individual notes can greatly contribute to an ensemble feeling. Thus, the present invention can output performance data that can be suitably used to synthesize tone signals having an ensemble feeling.

As an example, the series of performance data and the note controlling performance data of the predetermined type created for the plurality of channels are performance data accompanied by timing data. Because the series of performance data and the note controlling performance data are in a music piece data file format, they do not have to be processed in real time, which thus greatly facilitates processing of the performance data.

As an example, the deviation values for the plurality of channels are values created on the basis of a characteristic pattern of deviations of the predetermined tone characteristic of the note analyzed when a same musical score was actually performed simultaneously by a plurality of players equal in number to the channels. Because the deviation values for the plurality of channels are values created on the basis of actual measurements, the present invention can output performance data that can be suitably used to synthesize tone signals having a realistic ensemble feeling.

As an example, the inventive performance data processing method further comprises a number-of-channel designation step of designating a desired number N of the channels, and the setting step selects deviation values from a storage section storing deviation values for a plurality of channels presenting mutually different deviation states and sets the selected deviation values for the N channels. Therefore, the present invention can provide control values corresponding to the number of the channels. Particularly, by storing, in the storage section, deviation values having correlation between the channels as the deviation values of the plurality of channels presenting mutually different deviation states, the present invention can output note controlling performance data that can be suitably used to synthesize tone signals having a realistic ensemble feeling.

As an example, the storage section stores, for each of a plurality of channels, deviation values of a predetermined type of tone characteristic in association with a plurality of types of note controlling performance data, the detection step is directed to detecting any one of the plurality of types of note controlling performance data, and the setting step selects from the storage section the deviation values, for a plurality of channels, of the predetermined tone characteristic corresponding to the type of note controlling performance data detected by the detection step and thereby sets the deviation values, for the plurality of channels, of the predetermined tone characteristic. Thus, the present invention can perform processing on any of a plurality of types of note controlling performance data. Particularly, by storing, in the storage section, deviation values having correlation between a plurality of types of predetermined tone characteristics as the respective deviation values of the plurality of types of predetermined tone characteristics, the present invention can output note controlling performance data that can be suitably used to synthesize tone signals having a realistic ensemble feeling.

As an example, the setting step includes a step of further adjusting the set deviation value separately for each of the channels so that the adjusted deviation value of each of the channels is used by the generation step. Therefore, the present invention can readily adjust the deviation value for each of the channels. The adjustment of the deviation value may be performed by setting an offset or exaggeration coefficient.

As an example, in order to cause a control value of another predetermined tone characteristic of the note to vary each time the predetermined type of note controlling performance data is detected, the setting step further sets other deviation values for the plurality of channels, presenting mutually different deviation states, each time the predetermined type of note controlling performance data is detected. Each time the predetermined type of note controlling performance data is detected, the generation step causes the control value of the other predetermined tone characteristic of the note, included in the predetermined type of note controlling performance data created for each of the plurality of channels, to vary in accordance with a corresponding one of the other deviation values of the channels, further set by the setting step, so as to obtain channel-specific control values of the other predetermined tone characteristic, and thereby further generates the channel-specific control values as new control values of the other predetermined tone characteristic of the note for the individual channels. Thus, note controlling performance data of the predetermined type having, in addition to the new control values of the predetermined tone characteristic of the note, the new control values of the other predetermined tone characteristic of the note, further generated by the generation step, are created for the plurality of channels. Because both the control value of the predetermined tone characteristic and the control value of the other predetermined tone characteristic are caused to vary among the channels each time the predetermined type of note controlling performance data is detected, the present invention can generate and output performance data that can impart complicated variation to the tone characteristics.

According to another aspect of the present invention, there is provided a performance data processing method, which comprises: a step of receiving a series of performance data; a detection step of detecting a predetermined type of tone generator setting performance data from among the received series of performance data, the predetermined type of tone generator setting performance data including a tone generator setting value; a setting step of, each time the predetermined type of tone generator setting performance data is detected, setting deviation values for a plurality of channels presenting mutually different deviation states; and a generation step of, each time the predetermined type of tone generator setting performance data is detected, causing the tone generator setting value, included in the detected predetermined type of tone generator setting performance data, to vary among the plurality of channels in accordance with the respective deviation values of the channels, set by the setting step, so as to obtain channel-specific tone generator setting values, and generating, for the individual channels, the channel-specific tone generator setting values as new tone generator setting values. Thus, tone generator setting performance data of the predetermined type having the new tone generator setting values, generated by the generation step, are created for the plurality of channels. Therefore, each time a predetermined type of tone generator setting performance data is detected, the present invention can create tone generator setting performance data for a plurality of channels which have mutually different tone generator setting values. In tone generation, a tone generator device, where are set different tone generator setting values of the tone generator setting performance data for the plurality of channels, can synthesize tone signals with an ensemble feeing as if a plurality of players were executing an actual ensemble performance.

As an example, in order to cause the tone generator setting value to vary among the channels each time the predetermined type of tone generator setting performance data is detected, the setting step includes a step of setting deviation values for the plurality of channels, presenting mutually different deviation states, each time the predetermined type of tone generator setting performance data is detected. Thus, the present invention can output tone generator setting performance data for a plurality of channels which are varied in response to detection of a predetermined type of tone generator setting performance data and present mutually different deviation states. On the basis of such performance data having tone generator setting values differing among the channels, the tone generator device can synthesize tone signals of the individual channels with an ensemble feeing as if a plurality of players were executing an actual ensemble performance.

According to another aspect of the present invention, there is provided a tone signal synthesizing method, which comprises: a step of receiving a series of performance data; a detection step of detecting a predetermined type of note controlling performance data from among the received series of performance data, the predetermined type of note controlling performance data including a control value of a predetermined tone characteristic of a note; a setting step of, each time the predetermined type of note controlling performance data is detected, setting deviation values for a plurality of channels presenting mutually different deviation states, in order to cause the control value of the predetermined tone characteristic of the note to vary each time the predetermined type of note controlling performance data is detected; a generation step of, each time the predetermined type of note controlling performance data is detected, causing the control value of the predetermined tone characteristic of the note, included in the detected predetermined type of note controlling performance data, to vary among the plurality of channels in accordance with the respective deviation values of the channels set by the setting step so as to obtain channel-specific control values, and generating, for the individual channels, the channel-specific control values as new control values of the predetermined tone characteristic of the note; and a tone synthesis step of synthesizing tone signals for the plurality of channels in accordance with note controlling performance data of the predetermined type having the new control values of the predetermined tone characteristic of the note generated by the generation step. With the arrangements, the present invention can cause a predetermined tone characteristic of a note, constituting performance data, to vary among the channels each time predetermined type of note controlling performance data is detected, and synthesize tone signals which include respective control values presenting mutually different deviation states. By thus imparting such variation to the tone characteristic, the present invention can synthesize tone signals with an ensemble feeing as if a plurality of players were executing an actual ensemble performance According to another aspect of the present invention, there is provided a performance data processing method, which comprises: a step of receiving a series of performance data; a detection step of detecting a predetermined type of note controlling performance data from among the received series of performance data, the predetermined type of note controlling performance data including a control value of a predetermined tone characteristic of a note; a phrase detection step of detecting a break in a phrase within the series of performance data; a setting step of, each time the predetermined type of note controlling performance data is detected, setting a deviation value for at least one channel, in order to cause the control value of the predetermined tone characteristic of the note to vary each time the predetermined type of note controlling performance data is detected, the setting step setting the deviation value such that a deviation state of the deviation value of the at least one channel is varied each time a break in a phrase within the series of performance data is detected; and a generation step of, each time the predetermined type of note controlling performance data is detected, causing the control value of the predetermined tone characteristic of the note, included in the detected predetermined type of note controlling performance data, to vary in accordance with the deviation value of the at least one channel set by the setting step so as to obtain a varied control value, and generating the varied control value as a new control value of the predetermined tone characteristic of the note. In this manner, note controlling performance data of the predetermined type having the new control value of the predetermined tone characteristic of the note, generated by the generation step, is created for at least one channel. With the arrangements, the present invention can output note controlling performance data of at least one channel with a predetermined tone characteristic of a note varied each time a predetermined type of note controlling performance data is detected and deviation state varied each time a break in a phrase within the series of performance data is detected. By thus imparting such variation to the tone characteristic, the present invention can output note controlling performance data that can be suitably used to synthesize tone signals having unique expression.

As an example, the phrase detection step detects a break in a phrase within the series of performance data by detecting a break in a train of notes within the series of performance data. Thus, the present invention can readily detect a break in a phrase within the series of performance data without having to analyze the contents of music piece data, such as a melody pattern.

As an example, the predetermined tone characteristic of the note is note-on timing to start tone generation of the note. Variation in note-on timing of a note can greatly contribute to expression impartment to tone signals. Thus, the present invention can output performance data that can be suitably used to synthesize tone signals having unique expression.

As an example, the series of performance data and the note controlling performance data of the predetermined type created for at least one channel are performance data accompanied by timing data. Because the series of performance data and the note controlling performance data created for at least one channel are in a music piece data file format, they do not have to be processed in real time, which thus greatly facilitates processing of the performance data.

As an example, the deviation value for the at least one channel is a value created on the basis of a characteristic pattern of deviation of the predetermined tone characteristic of the note analyzed when a same musical score was actually performed by at least one player. Because the deviation values are values created on the basis of actual measurements, the present invention can output performance data that can be suitably used to synthesize tone signals having unique expression.

As an example, the setting step designates, from a storage section storing for at least one channel a series of deviation values indicative of a deviation state, an initial value in the series of deviation values of the at least one channel each time a break in a phrase within the series of performance data is detected and reads out, in accordance with predetermined order, of the at least one channel starting with the designated initial value each time the predetermined type of note controlling performance data is detected, to thereby set the deviation value for the at least one channel. According to actual measurements, there is correlation between positions of notes in a phrase (in-the-phrase positions of the notes) and deviation values. By storing deviation values having such correlation, the present invention can output to a tone generator device note controlling performance data that can be suitably used to synthesize tone signals having unique expression.

As an example, the setting step performs an arithmetic operation on the deviation value of the at least one channel, read out from the storage section, to vary the deviation state each time a break in a phrase within the series of performance data is detected. Thus, a different deviation state can be readily obtained per break in a phrase. Deviation value storage section only has to store deviation values for a phrase, and thus the necessary storage capacity of the deviation value storage section can be minimized. For example, the arithmetic operation may be multiplication by a random number.

As an example, the storage section stores a plurality of series of deviation values for a plurality of channels presenting mutually different deviation states, and the setting step selects the series of deviation values of at least one channel from the storage section, to thereby set the deviation value. Therefore, there can be provided control values corresponding to the number of channels.

As an example, the inventive performance data processing method further comprises a characteristic pattern detection step of detecting, for each performance section divided by the break in the phrase, a characteristic pattern of a train of notes included in the performance data within the performance section, and the setting step selects, in accordance with the characteristic pattern detected by the characteristic pattern detection step, a series of deviation values of at least one of the channels which is suitable for the detected characteristic pattern. Therefore, the present invention permits selection of a series of deviation values suitable for a phrase pattern.

As an example, the setting step designates, from storage section storing for at least one channel a plurality of series of deviation values indicative of mutually different deviation states, any one of the plurality of series of deviation values for the at least one channel each time a break in a phrase within the series of performance data is detected and reads out, in accordance with predetermined order, one the deviation values of the designated series of deviation values each time the predetermined type of note controlling performance data is detected, to thereby set the deviation value for the at least one channel. Therefore, a different deviation state can be readily obtained per phrase break. By storing, in the deviation value storage section, deviation values having correlation between a plurality of phrases, the present invention can output note controlling performance data that can be suitably used to synthesize tone signals having unique expression.

As an example, each time the predetermined type of note controlling performance data is detected, the setting step reads out one of the deviation values in the series of deviation values for the at least one channel first in accordance with predetermined order where the deviation value readout is executed first in a forward direction and then in a reverse direction and then the deviation value readout in the forward direction and reverse direction is repeated. According to actual measurements, there is correlation between positions of notes in a phrase (in-the-phrase positions of the notes) and deviation values, and there is a tendency for an initial deviation value, to be first selected, to greatly differ from the other deviation values. Further, the deviation value tend to greatly differ between an upbeat and downbeat within a phrase. By storing deviation values having such correlation in the storage section, the present invention can output note controlling performance data that can be suitably used to synthesize tone signals having unique expression.

As an example, the storage section stores, for at least one channel, deviation values of a predetermined type of tone characteristic in association with a plurality of types of note controlling performance data, and the setting step selects from the storage section the deviation values, for at least one channel, of the predetermined tone characteristic in accordance with the type of note controlling performance data and thereby sets the deviation value, for the at least one channel, of the predetermined tone characteristic. Thus, performance data processing can be performed on a plurality of types of note controlling performance data. Particularly, by storing, in the storage section, individual deviation values of a plurality of types of tone characteristics having correlation therebetween, the present invention can output note controlling performance data that can be suitably used to synthesize tone signals having unique expression.

As an example, the setting step includes a step of further adjusting the set deviation value for at least one channel so that the adjusted deviation value is used by the generation step. Thus, the present invention can readily adjust the deviation value. The adjustment of the deviation value may be performed by setting an offset or exaggeration coefficient.

According to another aspect of the present invention, there is provided a performance data processing method, which comprises: a step of receiving a series of performance data; a detection step of detecting a predetermined type of tone generator setting performance data from among the received series of performance data, the predetermined type of tone generator setting performance data including a tone generator setting value; a phrase detection step of detecting a break in a phrase within the series of performance data; a setting step of setting a deviation value for at least one channel to cause the tone generator setting value to vary each time the predetermined type of tone generator setting performance data is detected or each time a break in a phrase within the series of performance data is detected; and a generation step of, each time the predetermined type of tone generator setting performance data is detected, causing the tone generator setting value, included in the detected predetermined type of tone generator setting performance data, to vary in accordance with the deviation value of at least one channel set by the setting step so as to obtain a varied tone generator setting value and generating the varied tone generator setting value as a new tone generator setting value, the generation step being also arranged to, each time a break in a phrase within the series of performance data is detected, cause the tone generator setting value, included in the predetermined type of tone generator setting performance data last detected by the detection step, to vary in accordance with the deviation value of the at least one channel set by the setting step so as to obtain a varied tone generator setting value and then generate the varied tone generator setting value as a new tone generator setting value. Thus, tone generator setting performance data of the predetermined type having the new tone generator setting value, generated by the generation step, is created for the at least one channel. With such arrangements, each time a predetermined type of tone generator setting performance data is detected and then a phrase break is detected, the tone generator setting value of the predetermined type of tone generator setting performance data can be varied in accordance with the deviation value of at least one selected channel. By thus imparting such variation to the tone generator setting, the present invention can output, to a tone generator device, tone generator setting performance data that can be suitably used to synthesize tone signals having unique expression.

According to another aspect of the present invention, there is provided a tone signal synthesis method, which comprises: a step of receiving a series of performance data; a detection step of detecting a predetermined type of note controlling performance data from among the received series of performance data, the predetermined type of note controlling performance data including a control value of a predetermined tone characteristic of a note; a phrase detection step of detecting a break in a phrase within the series of performance data; a setting step of, each time the predetermined type of note controlling performance data is detected, setting a deviation value for at least one channel, in order to cause the control value of the predetermined tone characteristic of the note to vary each time the predetermined type of note controlling performance data is detected, the setting step setting the deviation value such that a deviation state of the deviation value of the at least one channel is varied each time a break in a phrase within the series of performance data is detected; a generation step of, each time the predetermined type of note controlling performance data is detected, causing the control value of the predetermined tone characteristic of the note, included in the detected predetermined type of note controlling performance data, to vary in accordance with the deviation value of the at least one channel set by the setting step so as to obtain a varied control value, and generating the varied control value as a new control value of the predetermined tone characteristic of the note; and a tone synthesis step of synthesizing a tone signal for the at least one channel in accordance with note controlling performance data of the predetermined type having the new control values of the predetermined tone characteristic of the note generated by the generation step. Thus, the present invention can synthesize tone signals of at least one channel with a predetermined tone characteristic of a note varied each time a predetermined type of note controlling performance data is detected and deviation state varied each time a break in a phrase within the series of performance data is detected. By thus imparting such variation to the tone characteristic, the present invention can synthesize tone signals having unique expression.

In the method including the phrase detection feature too, there can be output performance data that can be suitably used to synthesize tone signals imparted with an ensemble feeling, by generating performance data for a plurality of channels using respective deviation values of the plurality of channels. Tone generator device, where are set such performance data, can synthesize tone signals with an ensemble feeing as if a plurality of players were executing an actual ensemble performance, by performing waveform synthesis on the channel-by-channel basis while imparting such variation to the predetermined tone characteristic of the note constituting the performance data or tone setting value. If the deviation values of the plurality of channels have different deviation states (value deviating states), the ensemble feeling can be further enhanced.

The present invention may be constructed and implemented not only as the method invention as discussed above but also as an apparatus invention. Also, the present invention may be arranged and implemented as a software program for execution by a processor such as a computer or DSP, as well as a storage medium storing such a software program. Further, the processor used in the present invention may comprise a dedicated processor with dedicated logic built in hardware, not to mention a computer or other general-purpose type processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which.

DETAILED DESCRIPTION OF EMBODIMENTS

Figure 1:
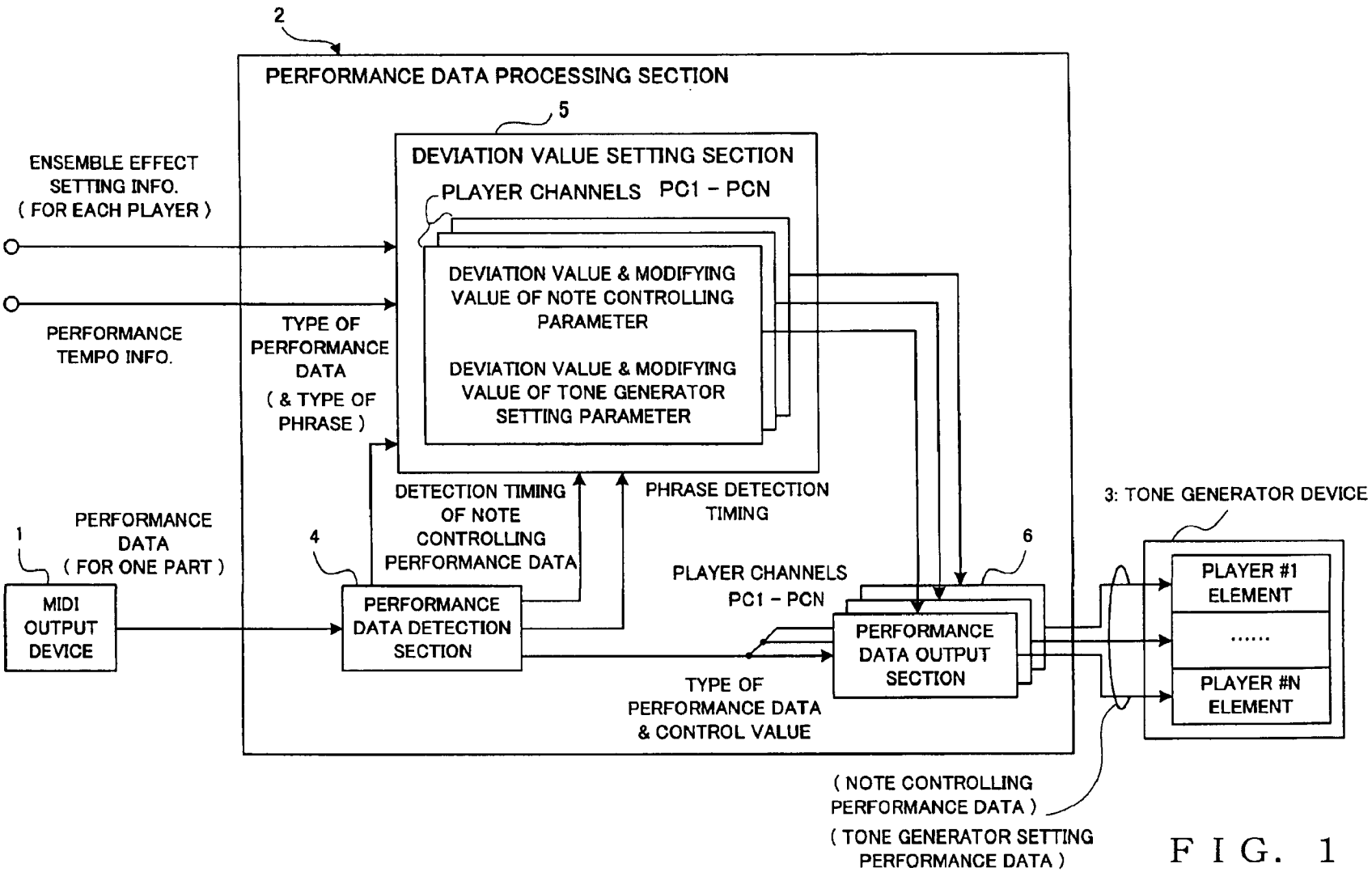
FIG. 1 is a block diagram explanatory of an embodiment of a system for practicing a performance data processing method of the present invention.

FIG. 1 is a block diagram explanatory of an embodiment of a system for practicing a performance data processing method of the present invention.

In FIG. 1, reference numeral 1 represents a MIDI output device 1, 2 a performance data processing section, and 3 a tone generator device. For example, the MIDI output device 1 is a MIDI keyboard that is performed in real time, or a sequencer device that reproduce music piece data.

The performance data processing section 2 receives performance data from the MIDI output device 1, generates performance data of a plurality of player channels, and then output the thus-generated performance data to the tone generator device 3. When note controlling performance data, having a different control value, is detected, the performance data processing section 2 generates note controlling performance data for a plurality of player channels that present different deviation states, i.e. value deviating states, or different deviation patterns reflecting character or individuality of each of the players. Namely, the performance data processing section 2 detects a predetermined type of note controlling performance data from among a series of performance data received from the MIDI output device 1; each time the predetermined type of note controlling performance data is detected, a control value of a predetermined tone characteristic of the detected performance data is caused to vary among the player channels in accordance with a characteristic based on a desired deviation state (value deviating state) of a given one of the player channels so as to have character or individuality of the corresponding player (i.e., player of the given channel) reflected in the control value, so that note controlling performance data for the given player (i.e., player of the given channel) can be generated. Such note controlling performance data is generated for each of a plurality of players (plurality of channels) in accordance with respective deviation states (value deviating states), varying among the players, in such a manner that the character of all the players is duly reflected in the note controlling performance data.

The tone generator device 3 includes a plurality of player elements for synthesizing tone signals corresponding to a plurality of player channels. Whereas the player channels for generating variation and the player elements for synthesizing tone signals are shown as corresponding in number, the numbers of the player channels and player elements do not necessarily have to agree with each other; for example, the number of the player elements may be greater than the number of the player channels.

Namely, the tone generator device 3 synthesizes a tone signal for each of the player elements on the basis of the input performance data of the corresponding one of the player channels, and thereby outputs the synthesized tone signals, having an ensemble feeling, via speakers in monaural or stereo fashion.

As will be later described in detail in relation to FIGS. 9A–9C, performance data are sometimes input from a music piece data storage section instead of the MIDI output device 1, and performance data are sometimes output to a music piece data storage section rather than to the MIDI output device 1.

The MIDI output device 1 outputs, for example, MIDI sequence data as the performance data. Normally, impartment of an ensemble effect is performed on a single performance part, and thus the performance data processing section 2 performs processing on a MIDI sequence of a MIDI channel corresponding to one performance part. If another ensemble effect is to be imparted, the performance data processing section 2 performs processing on another performance part. For convenience of description, let it be assumed here that a particular performance part to be imparted with an ensemble effect has been selected in advance by the user, and the following descriptions will be made only about processing of performance data in such a performance part to be imparted with an ensemble effect. Needless to say, a performance part to be imparted with an ensemble effect may be selected in real time, manually or automatically, in accordance with the nature of a performance.

The performance data includes tone generator controlling parameters for controlling the tone generator device 3, and the tone generator controlling parameters can be classified into note controlling parameters (note controlling performance data) and tone generator setting parameters (tone generator setting performance data).

The note controlling performance data includes control values for controlling characteristics of individual notes (individual tones) on a musical score. Examples of the note controlling performance data includes a "note-on message", "note-off message", etc.

The tone generator setting performance data includes tone generator setting values for setting tone characteristics of a tone generator (tone generator setting parameters), which set tone generator setting parameters in corresponding player elements. The tone generator setting parameters uniformly control tone characteristics of all notes to be processed by the individual player elements. Examples of the tone generator setting performance data includes a "program change message".

In some cases, it is desirable that even parameters generally regarded as tone generator setting parameters be used to control tone characteristics of individual notes; such tone generator setting parameters are treated as note controlling parameters in the instant embodiment.

Process for imparting an effect of an ensemble need not be performed on all of such note controlling performance data and tone generator setting performance data; namely, the ensemble effect imparting process may be performed only on predetermined ones of the note controlling performance data and tone generator setting performance data.

For example, setting may be made for the note-off message" so as not to control the settings of the note controlling parameter. Other performance data than the predetermined performance data only have to be copied directly to a plurality of player channels and then output to the tone generator device 3.

Alternatively, because other performance data than the predetermined performance data are output with no player channel designated therefor, the tone generator device 3 may synthesize tone signals by automatically copying control values of the note controlling parameters or tone generator setting values of the tone generator setting parameters.

The performance data processing section 2 includes a performance data detection section 4, a deviation value setting section 5, and a performance data output section 6.

The user performs ensemble effect setting operation on the deviation value setting section 5 of the performance data processing section 2. Specifically, the user first sets a particular number N of the player channels and then performs ensemble effect setting operation for each of the player channels PC1–PCN.

Deviation values of the note controlling parameters and tone generator setting parameters to be controlled are prepared for each of the player channels PC1–PCN. The note controlling parameter of each of the player channels includes a string or series of deviation values composed of a plurality of deviation values that are sequentially selected and used. The tone generator setting parameter of each of the player channels typically includes one deviation value.

It is advantageous that the respective deviation values of the individual player channels PC1–PCN have correlation between the channels as in the case of an actual performance.

First, the note controlling parameter is described below. "Player #1" has deviation values $a_{11}$, $a_{12}$, $a_{13}$ and $a_{14}$ of a given type of note controlling parameter Pa, and deviation values $b_{11}$, $b_{12}$, $b_{13}$ and $b_{14}$ of another type of note controlling parameter Pb. Similarly "player #2" has deviation values $a_{21}$, $a_{22}$, $a_{23}$ and $a_{24}$ of a given type of note controlling parameter Pa, and deviation values $b_{21}$, $b_{22}$, $b_{23}$ and $b_{24}$ of another type of note controlling parameter Pb. Note controlling parameter for any other player, if any, are constructed similarly to the above-mentioned. Namely, for the other player too, each type of note controlling parameter has a plurality of deviation values. In the case where two or more different types of note controlling parameters are used, each of the types of the note controlling parameters has a plurality of deviation values.

The deviation values of each of the note controlling parameters are different from each other. For example, the deviation values $a_{11}$, $a_{12}$, $a_{13}$ and $a_{14}$ of the note controlling parameter are values different from each other. However, the deviation values are not values selected in an entirely random manner, but have mutual correlation because they are values selected in accordance with a position, in a phrase, of the corresponding note (in-the-phrase position of the note), type of the phrase, individuality of the player, etc.

Each performance data received from the MIDI output device 1 is passed to the performance data detection section 4 for detection or identification of the type of the performance data, from which it is delivered to the deviation value setting section 5. As will be later described, the of the phrase is also identified so that the identified type is sent to the deviation value setting section 5.

Also, detection timing of note controlling performance data, such as a note-on message, and phrase detection timing, such as a break in a phrase, is also detected and sent to the deviation value setting section 5. Further, the detected type of the predetermined performance data and control value of each note controlling parameter included in the predetermined performance data are sent to a performance data output section 6.

It is determined whether or not a silent time interval between successive notes, more specifically a time interval from note-off timing of a preceding note to note-on timing of a succeeding note, is equal to or greater than a predetermined threshold value, to thereby detect timing of a break in a train of notes and judges the detected timing to be a break in a phrase. The above-mentioned predetermined threshold value is adjustable by the user. It is sometimes desirable that the predetermined threshold value be modified depending on music pieces, although the threshold value need not necessarily be modified depending on performance tempos of music pieces.

Since the break in the phrase represents a break where the motif of the music piece changes, the break of the phrase may be detected by analyzing the contents of the music piece. Alternatively, if the input performance data includes information indicative of a break in a phrase, then the information may be used.

When the input performance data has been detected as being a predetermined type of note controlling performance data, the deviation value setting section 5 selects, from among the deviation values of note controlling parameters Pa, Pb, . . . for the individual player channels PC1–PCN, deviation values of a note controlling parameter corresponding to a predetermined tone characteristic to be controlled by the predetermined type of note controlling performance data, e.g. deviation values of a note controlling parameter Pa, and sets the thus-selected deviation values for the individual player channels PC1–PCN.

For example, as regards the first player, each time a predetermined type of note controlling performance data (e.g., note-on message) is detected (e.g., each time a note is detected), any one of the deviation values $a_{11}$, $a_{12}$, $a_{13}$ and $a_{14}$ of the note controlling parameter Pa (e.g., note-on timing) is selected in accordance with predetermined order in which the deviation values are arranged. The deviation values prepared for each of the players are values different from each other, and the deviation values of the note controlling parameter Pa differ in deviation state (i.e. deviation pattern) among the player channels PC1–PCN.

Once a predetermined type of note controlling performance data (e.g., note-on message) is input and detected by the performance data detection section 4, the performance data output section 6 detects or identifies the type of the predetermined note controlling performance data and control value of the note controlling parameter Pa (e.g., note-on timing). Then, on the basis of the control value of the note controlling parameter Pa, the performance data output section 6 sets, in the individual player channels PC1–PCN, control values varying from each other in accordance with the deviation values $a_{11}$, $a_{21}$, $a_{31}$, . . . , $a_{N1}$ of the note controlling parameter Pa set in corresponding relation to the player channels PC1–PCN.

For example, the control value included in the input note controlling performance data (i.e., original control value) is added with or multiplied by the respective deviation values $a_{11}, a_{21}, a_{31}, \ldots, a_{N1}$ of the player channels PC1–PCN and thereby sets the added or multiplied results new control values of the predetermined note controlling parameter for the individual player channels PC1–PCN.

Either of the addition with or multiplication by the deviation values may be performed as appropriate depending on the nature of the note controlling parameter to be controlled. Alternatively, any other suitable arithmetic operation than the addition or multiplication may be performed.

The performance data output section 6 uses these new channel-specific control values to generate, for the player channels, PC1–PCN, note controlling performance data of the same type as the input predetermined note controlling performance data.

In this manner, each time note controlling performance data is input and detected, the performance data output section 6 outputs, to the player elements corresponding to the player channels PC1–PCN within the tone generator device 3, channel-specific note controlling performance data having their respective control values of a predetermined note controlling parameter which have been varied in accordance with corresponding deviation values.

If the input note controlling performance data is intended to control a plurality of note controlling parameters (like a "note-on message" including three note controlling parameters: note-on timing; note number; and velocity (on-velocity)), the deviation value setting section 5 may set in advance which one or more of the plurality of note controlling parameters are to be varied.

The deviation value setting section 5 varies the deviation values of each of the note controlling parameters Pa, Pb, . . . each time the corresponding predetermined note controlling performance data is detected, and also, each time a phrase is detected, the setting section 5 switches the currently-used series of deviation values to another series of deviation values (i.e., another take). By so doing, the deviation value setting section 5 can even further enhance an ensemble feeling.

For example, when a phrase is detected, the currently-used series of deviation values $a_{11}$, $a_{12}$, $a_{13}$ and $a_{14}$ of the note controlling parameter Pa of the first player is switched to another series of deviation values $a'_{11}$, $a'_{12}$, $a'_{13}$ and $a'_{14}$.

The performance data detection section 4 may analyze musical characteristics of the phrase and output an identified type of the phrase to the deviation value setting section 5. In turn, the deviation value setting section 5 varies the deviation state or pattern of the note controlling parameter, for example, by selecting and setting a series of deviation values (take) corresponding to the phrase type, so as to dynamically impart appropriate variation to the note controlling parameter.

Specifically, the performance data detection section 4 analyzes time-value arrangement patterns of notes within the phrase, i.e. melody pattern (tone pitch pattern), note-on timing variation pattern, rhythm pattern of downbeats and upbeats, etc. For example, if the tone pitch pattern is of a mountain shape, the deviation value of a peak portion of the mountain is decreased, and/or the deviation value of a beat position corresponding to the bottom of a beat in the time-value arrangement pattern is increased by the performance data detection section 4.

Because the phrase type can be determined only after a performance of the phrase is started, it can not be determined in advance where the tone generator device 3 executes a real-time performance. In a form of music performance where the tone generator device 3 outputs performance data with a delay of a predetermined time, the predetermined time delay may be determined such that the phrase type can be determined in time.

The deviation value setting section 5 also receives performance tempo information as a control input. This is because degree of the deviation value variation has to be adjusted in accordance with a performance tempo when a predetermined tone characteristic to be controlled is a timing-related note controlling parameter.

The performance tempo information represents a performance tempo of an input MIDI sequence. The performance tempo information may be included in performance data to be supplied from the MIDI output device 1 to the performance data processing section 2 or may be previously input by the user to the performance data processing section 2. In an alternative, the performance tempo may be estimated on the basis of a MIDI sequence of performance data output from the MIDI output device 1.

The following paragraphs describe an example of behavior of the instant embodiment when input performance data is tone generator setting performance data that uniformly control a tone characteristic of all notes to be processed by the individual player elements.

In this case, the performance data processing section 2 carries out operations different from those to be carried out when note controlling performance data is input.

The performance data detection section 4 detects and outputs the type of the predetermined tone generator setting performance data to the deviation value setting section 5, and it also outputs, to the performance data output section 6, the type of the tone generator setting performance data and control value of a tone generator setting parameter included in the performance data.

For each of the player channels PC1–PCN, the deviation value setting section 5 selects a deviation value of the tone generator setting parameter which corresponds to the predetermined tone generator setting performance data, and it outputs the selected deviation value to the performance data output section 6.

The performance data output section 6 generates, for each of the player channels PC1–PCN, new tone generator setting performance data of the same type as the input predetermined tone generator setting performance data. At that time, in response to detection of the input predetermined tone generator setting performance data, the control value of the tone generator setting parameter, included in the predetermined tone generator setting performance data, is varied among the player channels PC1–PCN in accordance with the respective deviation values of the player channels PC1–PCN selected by the deviation value setting section 5, and such varied channel-specific values are provided as new setting values of the tone generator setting parameter for the channels PC1–PCN.

In the above-mentioned manner, each time tone generator setting performance data is input and detected, the performance data output section 6 outputs, to the player elements corresponding to the player channels PC1–PCN within the tone generator device 3, channel-specific tone generator setting performance data having their respective tone generator setting values which are different among the channels PC1–PCN.

For each of the player channels PC1–PCN, the original tone generator setting value, included in the input tone generator setting performance data, is added with or multiplied by the deviation value; thus, new control values of the predetermined tone generator controlling parameter are set for the individual player channels PC1–PCN. In this case, addition with or multiplication by the deviation values may be performed as appropriate depending on the nature of the tone generator setting parameter to be set. Alternatively, any other suitable arithmetic operation than the addition or multiplication may be performed.

Where the input predetermined tone generator setting performance data is intended to simultaneously set a plurality of tone generator setting parameters, it may be preset which one or more of the plurality of tone generator setting parameters are to be varied.

Because there is no need to vary over time the tone generator setting parameter, the respective deviation values for the individual player channels PC1–PCN need not be varied each time predetermined tone generator setting performance data is input, and the deviation values need not be controlled in accordance with performance tempo information. However, the currently-used series of deviation values of the tone generator setting parameter may also be switched to another series of deviation values (other take) in response to detection of each phrase or in accordance with a particular type of the phrase, to thereby dynamically impart appropriate variation.

When such tone generator setting performance data having channel-specific tone generator setting values is supplied to the tone generator device 3, the tone generator device 3 retains the tone generator setting values as they are.

Therefore, the performance data output section 6 retains the tone generator setting value included in the last-detected tone generator setting performance data. Thus, when a phrase is detected, the performance data output section 6 generates and outputs channel-specific predetermined tone generator setting performance data having new tone generator setting values varied, for example, by adding the switched deviation values to the retained tone generator setting value.

For data transfer from the performance data processing section 2 to the tone generator device 3, there may be employed an interface suitable for input specifications of the tone generator device 3.

Even at a subsequent processing stage, the performance data output from the performance data output section 6 can be subjected, separately for each of the player channels PC1–PCN, to any of various note controlling and tone generator setting operations, if the output performance data has not yet undergone waveform synthesis.

Where the tone generator device 3 has only one input like a MIDI interface, information specifying a performance part and player may be included in the performance data; for example, a MIDI channel number may be used. The performance data output section 6 only has to convert the MIDI channel number, indicative of a performance part of the performance data input from the MIDI output device 1, into another MIDI channel number capable of specifying both the performance part and the player.

Where the tone generator device 3 is designed to receive, on a time-divisional basis, performance data of a given performance part directed to its given player element, the performance data output section 6 only has to output the performance data in accordance with the time-divisional channels.

Where the tone generator device 3 is designed to receive note controlling performance data and tone generator setting performance data on separate lines, the performance data output section 6 outputs the note controlling performance data and tone generator setting performance data separately in accordance with the input structure of the tone generator device 3.

Some type of tone generator device 3 is designed to receive only limited performance data, such as a note-on message and note-off message. In such a case, the performance data processing section 2 may transfer only performance data that can be received by the tone generator device 3.

The following paragraphs describe specific examples of ensemble effect setting information in relation to MIDI data.

Examples of the note controlling performance data include "note-on message", "note-off message", "polyphonic key pressure message", etc.

The "note-on message" indicates, to the tone generator, control values of note-on timing, note number (tone pitch) and velocity (on-velocity) that are note controlling parameters.

The "note-off message" indicates, to the tone generator, control values of note-off timing, note number (tone pitch) and velocity (off-velocity).

The "polyphonic key pressure message" is intended to control a tone characteristic of a given currently-sounded note by designating the note number (tone pitch) of the note. To a pressure value of the "polyphonic key pressure message" may be allocated control values of a tone pitch, filter cutoff frequency, tone volume, pitch depth of a low-frequency oscillator, filter depth, amplitude depth, etc. that are fundamentally tone generator controlling parameters.

On the other hand, examples of the tone generator setting performance data include "program change message", "control change message", etc.

The "program change message" controls a tone color parameter, one of the tone generator setting parameters, by designating a voice (tone color) number.

Envelope rise time or delay vibrato start timing, one of the tone generator setting parameters, can be set by setting a value of "attack time", "vibrato delay" or the like using a "non-registered parameter number" (hereinafter also referred to simply as "NRPN") of the "control change message".

In addition to the above-mentioned examples, the "NRPN" can be used to set various tone generator setting parameters, such as envelope-related, vibrator-related, low-pass-related, equalizing (frequency characteristics of a tone signal)-related parameters.

Whereas the preceding paragraphs have described separately the note control parameters and the tone generator setting parameters, some tone generator setting parameters, such as "delay vibrato start timing", can be used either for controlling a note or setting the tone generator, or for both controlling a note and setting the tone generator. For that purpose, any suitable approach may be employed; for example, original rules may be followed if performance data can be defined in accordance with the original rules, or, in a case where the current MIDI standard is used too, there may be used the above-mentioned "polyphonic key pressure message" or an approach as will be described later in relation to FIG. 3C.

Figure 2:
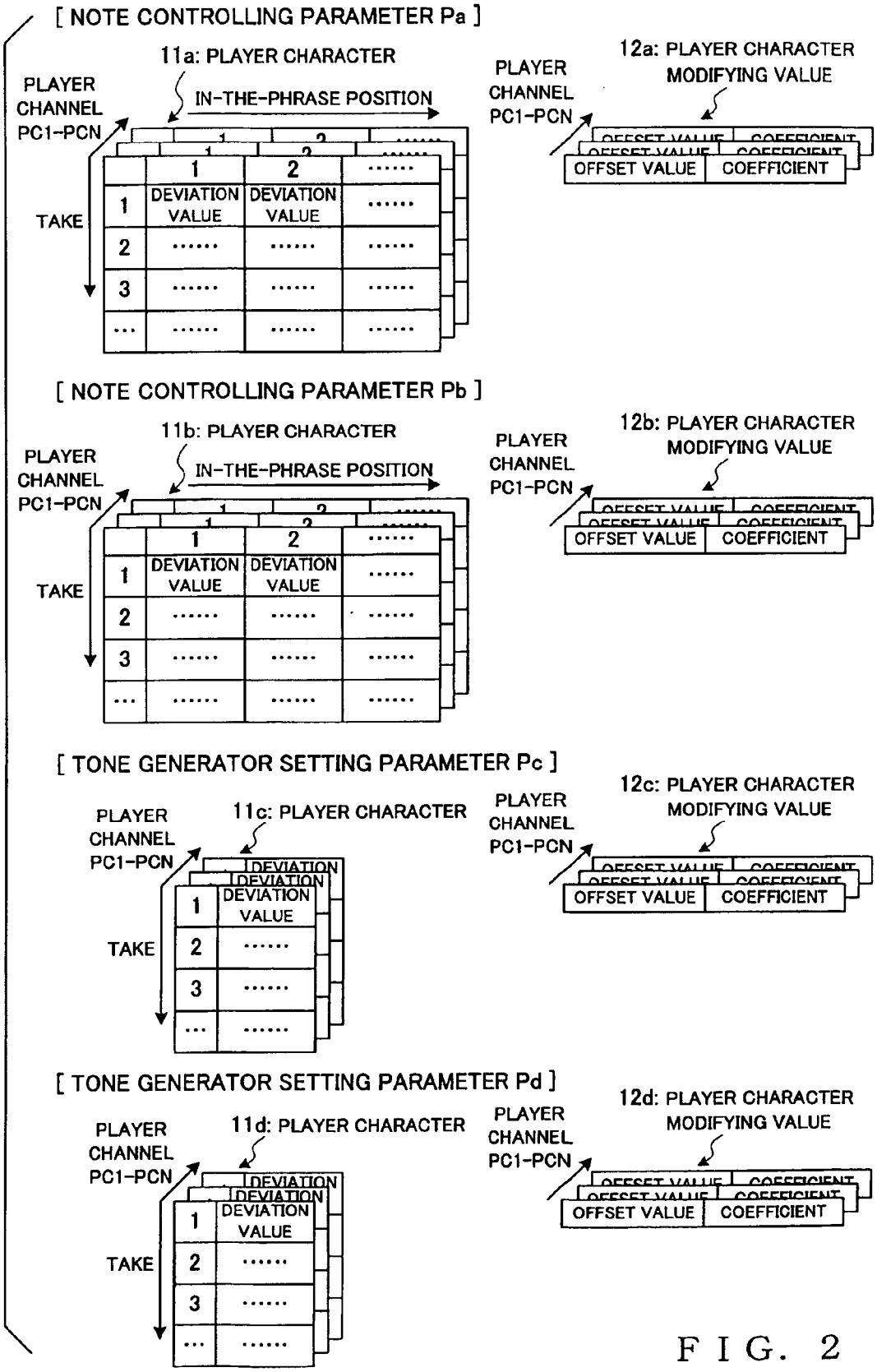
FIG. 2 is a diagram explanatory of exemplary storage formats of ensemble effect setting information.

FIG. 2 is a diagram explanatory of an exemplary manner in which ensemble effect setting information is stored in memory.

The ensemble effect setting information includes player characters and player character modifying values, which is set for every one or more note controlling parameters or every one or more tone generator setting parameters. The ensemble effect setting information is prestored in an external storage device, such as a ROM (Read-Only Memory) or hard disk.

Let it be assumed here that player characters 11*a*, 11*b*, 11*c* and 11*d* are prepared for each of the player channels PC1–PCN. The player characters 11*a* and 11*b* are player characters of note controlling parameters Pa and Pb, and the player character modifying values 12*a* and 12*b* are player character modifying values of the note controlling parameters Pa and Pb. Similarly, the player characters 11*c* and 11*d* are player characters of tone generator setting parameters Pc and Pd, and the player character modifying values 12*c* and 12*d* are player character modifying values of the tone generator setting parameters Pc and Pd.

Each of the player characters is represented by deviation values from the original control values of the note controlling parameters or deviation values from the tone generator setting values of the tone generator setting parameters. The deviation value is defined as an offset (to-be-added value) or deviation rate (weighting coefficient).

The player character 11*a* of the note controlling parameter Pa has a plurality of deviation value series (takes), and each of the takes is designated by a take number and comprises a plurality of deviation values different from each other. In addition, the deviation state or pattern of the deviation values is different among the player channels PC1–PCN. The player character 11*b* is constructed in a similar manner to the player character 11*a*.

Each time a phrase is detected, readout of an initial value (first value) in a next take (deviation value series; column in the illustrated example) is instructed.

Also, each time predetermined note controlling performance data corresponding to the note controlling parameter Pa is detected, the deviation values in the take are sequentially read out (in the horizontal direction in the illustrated example).

In the case of the "note-on message", when a note in the phrase is detected, a value of note-on timing, for example, is varied by selecting one of the deviation values in accordance with its detected position within the phrase. When other predetermined note controlling performance data is detected, a value of a predetermined note controlling performance is varied by selecting a deviation value in accordance with the detected position.

Further, each time there occurs a changeover from one phrase to another, one take number is changed to another. When a phrase changeover takes place while the last take number is being selected, the last take number is switched back to the first take number.

Instead of the take number being switched sequentially, a plurality of takes corresponding to a type of a phrase may be prestored, in which case the phrase type is determined by analysis of the input performance data and one of the take numbers suitable for the determined phrase type is selected.

Namely, for each individual note, the player character serves to impart character of the player to variation in the deviation values that are given each time predetermined note controlling performance data is input.

The player character modifying value is intended to give a further change to the deviation value selected by the player character, and it can be set as desired by the user. In the illustrated example, a uniform modifying value is used for each of the player channels PC1–PCN irrespective of the take of the player character and position of the note within the phrase.

In specific examples to be later explained with respect to FIG. 11 and subsequent figures, the player character modifying value comprises an offset value to be added to a value set by the player character, and an exaggeration coefficient to be multiplied with the value added with the offset value. Sometimes, the player character modifying value is modified or adjusted using a current performance tempo as a variable. In FIG. 1, the deviation value setting section 5 outputs the thus-adjusted deviation value to the performance data output section 6.

Note that the player character modifying value may comprise a single offset value and exaggeration coefficient to be shared among the player channels PC1–PCN.

Combination of such an offset value and exaggeration coefficient is just an example of the player character modifying value; namely, the player character modifying value may be any value as long as it modifies or qualifies the player character. Further, the player character modifying value may be arithmetically operated with the deviation values, given as the player character, in any suitable manner.

There are also stored the player characters 11*c* and 11*d* and player character modifying values 12*c* and 12*d*, in corresponding relation to tone generator setting performance data, for the tone generator setting parameters Pc and Pd and for each of the player channels PC1–PCN.

Since tone generator setting parameters, such as a "program change message", are considered to have relatively low importance for an ensemble effect, each of the tone generator setting parameters in the illustrated example comprises a single deviation value that does not vary in accordance with a position, within a phrase, of the corresponding tone generator setting data; however, the single deviation value may be varied in accordance with a position, within a phrase, of the corresponding tone generator setting data.

Further, whereas the preceding paragraphs have described the case where there are prepared in advance a plurality of takes, there may be prepared only one take if the take is not to be changed per phrase detection or per type of phrase detected.

Once a particular value of the tone generator setting parameter is set in the tone generator device 3, the tone generator setting parameter value is kept at that particular value. Thus, in the case where one take is changed over to another per phrase detection or a take is selected per type of phrase detected, it is necessary to generate tone generator setting performance data and output the thus-generated performance data to the tone generator device 3 each time there occurs a changeover or selection of the take.

Specifically, the original tone generator setting value included in predetermined tone generator setting performance data, input of which has been detected last, is retained and the retained setting value is adjusted with deviation values of a new take and further adjusted with a player character modifying value, so that tone generator setting performance data, having the thus-adjusted value as a new tone generator setting value, is generated and output to the tone generator device 3.

Of some of the tone generator setting parameters, numerical continuity of the tone generator setting values do not necessarily mean continuity in the contents of the tone generator setting parameter, as in the case of tone color numbers. In this case, varying the original control value in accordance with the deviation values means imparting variation to the contents of the tone generator setting parameter, for example, to effect a change to a closely-resembling tone color. Therefore, the deviation values in this case are not necessarily values to be added to or multiplied with the original control value. Namely, the control value variation should be performed by control for achieving an approximate tone color, rather than by control based on simple numerical value modification.

In the illustrated example of FIG. 2, it is assumed that the number of the pre-stored player characters correspond to the number N of the player channels; in practice, however, the number N of the player channels is set as desired by the user. Therefore, there may be prestored respective information of player characters as shown in FIG. 2 in association with various values N of the number of player channels selectable or settable by the user so that, as the user selects or sets a desired number of the player channels, any one of the player character information, corresponding to the selected or set number of the player channels, is read out and automatically set. In an alternative, there may be prestored respective information of player characters as shown in FIG. 2 in association with a usable maximum (sufficiently great) number M of player channels so that, as the user selects or sets a desired number N of the player channels, the player character information, corresponding in number to the number N selected or set from the maximum number M, is automatically read out and set.

In another alternative, there may be prestored a sufficient number M of channels of player characters so that the user can select any of the player channels PC1–PCN in accordance with a desired number N of player channels to be used.

The user first selects player characters of the player channels PC1–PCN from among the player characters stored in a memory or storage device and selects desired player character modifying values. In this way, it is possible to impart diversified variation to the selected player characters.

Let it be assumed that the ensemble effect setting information is previously set in the storage device before input of performance data; however, the settings of the ensemble effect setting information may be changed in the course of a performance of a music piece. For example, the number of the player channels and/or the player channels selected may be changed during reproduction of the music piece. Further, any of the player character modifying values may be changed, during the reproduction of the music piece; for example, degree of the variation may be controlled by changing the exaggeration coefficient value.

In the illustrated example, sets of player characters (deviation values) corresponding to a plurality of note controlling parameters and a plurality of tone generator setting parameters are stored in association with the player channels PC1–PCN.

By thus storing the player characters in sets in a case where there is correlation between the note controlling parameters and between the tone generator setting parameters because they concern a same player, character of the player can be reflected finely.

The user designates a desired player to select deviation values of each note controlling parameter and tone generator setting parameter.

However, for note controlling parameters and tone generator setting parameters having only small correlation therebetween, there may be prestored a player character for each of the parameters so that the user can determine a desired combination of character of the players. For example, sets of player characters (deviation values) of note controlling parameters and sets of player characters (deviation values) of tone generator setting parameters may be prestored in separately.

It is desirable that the deviation values of the note controlling parameters and tone generator setting parameters of the player channels PC1–PCN to be used should be created on the basis of characteristic patterns of variation in tone characteristic of individual notes analyzed as the first to N-th players execute an actual performance on the basis of a same musical score. By thus using the deviation values based on the actual performance, it is possible to provide a natural ensemble feeling.

The deviation values of the tone generator setting parameters may also be created on the basis of characteristic patterns of variation in tone characteristic peculiar to the first to N-th musical instruments of a same type used in an actual performance.

Figure 3A:
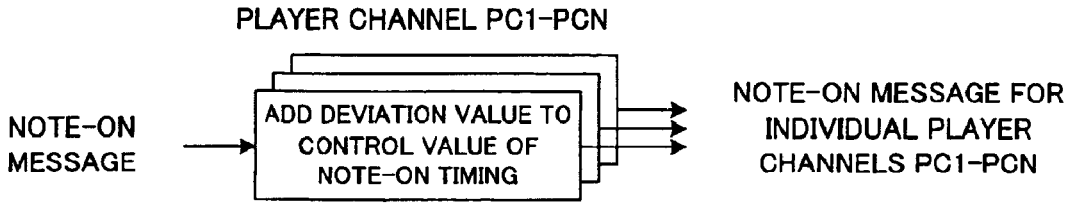
FIGS. 3A–3C are diagrams explanatory of a specific manner in which performance data is generated for each player in the system of FIG. 1.
Figure 3B:
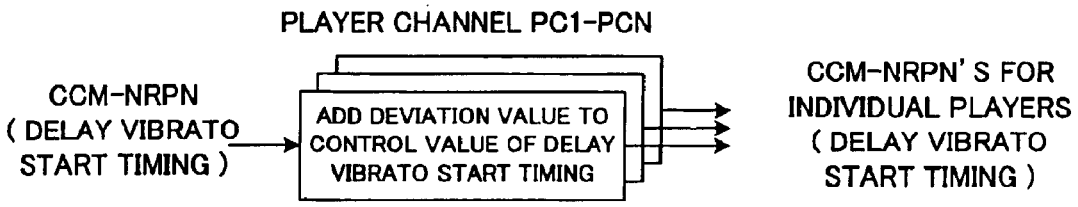

FIGS. 3A–3B are diagram explanatory of specific examples of performance data generated for the individual player channels in the system of FIG. 1.

FIG. 3A shows a case where the control value of note-on timing of a note in a "note-on message" is varied each time a note-on message (i.e., note) is input to and detected by the performance data processing section 2.

Where the MIDI output device 1 of FIG. 1 is a MIDI keyboard, MIDI data output in response to an actual performance of a human player do not include data of "event generation timing", such as note-on timing, a time point when a note-on message is output from the MIDI output device 1 is regarded as note-on timing.

Where, on the other hand, the MIDI output device 1 of FIG. 1 is a storage device storing music piece data files, MIDI data output from the MIDI output device 1 include data indicative of "event generation timing" in some form or other.

The deviation value setting section 5 of FIG. 1 outputs "note-on messages" for the player channels PC1–PCN having new control values that have been varied, for example, by adding, to the original control value of the note-on timing included in a "note-on message" detected by the setting section 5, respective deviation values of the player channels PC1–PCN presenting mutually different deviation states or pattern.

The plurality of "note-on messages" output from the deviation value setting section 5 may include one or more note-on messages having the same control value as the input note-on message, in which case the deviation value is "0". Such a player corresponding to the "0" deviation value carries significance as a player of character to perform exactly to the musical score.

If control values of a note number and velocity (on-velocity) in the "note-on message" are not varied, these control values may be set directly as note numbers and velocities (on-velocities) of respective "note-on messages" of the player channels PC1–PCN.

Where the performance data is real-time MIDI data, the tone generator device 3 of FIG. 1 interprets, as note-on timing, a time point when a "note-on message" is input. Therefore, it is necessary for the performance data output section 6 to control a time point for outputting the "note-on message" in accordance with the deviation values.

However, where the deviation values are added to the note-on timing of the input "note-on message", a portion of the deviation values may become a negative value (i.e., value to set back the note-on timing). Therefore, in a case where the performance data processing section 2 performs a real-time process, arrangements are made to output note controlling performance data with a predetermined slight time delay even if the deviation value is "0". Alternatively, if the deviation value is a negative value, it may be regarded as a "zero" value so as to simplify the process.

FIG. 3B shows a case where the control value of delay vibrato start timing, designated by a predetermined non-registered parameter number (hereinafter also referred to as "CCM-NRPN") that is one type of "control change message" input to and detected by the performance data processing section 2, is varied each time the predetermined "CCM-NRPN" is detected. In this case, the delay vibrato start timing is not intended to control a particular note, but functions to uniformly control tone characteristics of all notes to be processed by the individual player elements.

In this case, the deviation value setting section 5 outputs predetermined "CCM-NRPNs" for the player channels PC1–PCN having new control values that have been varied, for example, by adding, to the original control value of the delay vibrato start timing included in a predetermined "CCM-NRPN" detected by the setting section 5, respective deviation values for the channels PC1–PCN presenting mutually different deviation states or patterns.

The predetermined "CCM-NRPNs" for the player channels PC1–PCN are output at timing delayed a predetermined time behind their generated time or input time. The output timing of the "CCM-NRPNs" may slightly vary among the players.

Where the predetermined "CCM-NRPNs" are output along with event generation timing data, the event generation timing, in principle, are set to a same value as the event generation timing of the input predetermined "CCM-NRPN".

Because, as previously noted in relation to the "note-on event message", the event generation timing data may be expressed in any one of various formats, the performance data output section 6 expresses the event generation timing data of the performance data with a desired format taken into account.

Note that the plurality of predetermined "CCM-NRPNs" output from the deviation value setting section 5 may include one or more CCM-NRPNs having the same control value as the input CCM-NRPN.

Figure 3C:
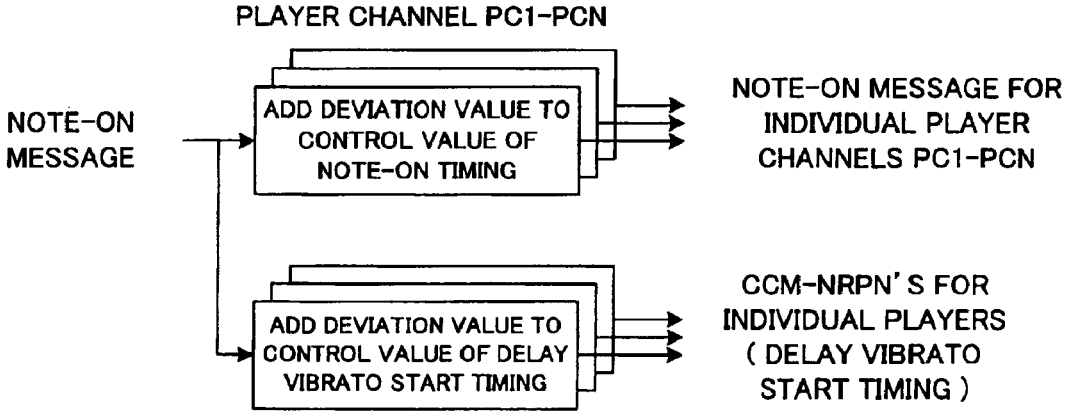

Further, FIG. 3C shows a case where the control value of note-on timing of a note in a note-on message is varied each time a note-on message (i.e., a note) is input to and detected by the performance data processing section 2 and another control value than that of the note-on timing, such as the above-mentioned delay vibrato start timing, is also varied from a predetermined value.

It may be set in advance whether note-on messages should be simply output in response to the detected note-on message as shown in FIG. 3A or another note controlling parameter than the note-on message too should be varied as shown in FIG. 3C.

The performance data output section 6 of FIG. 1 outputs "note-on messages" for the player channels PC1–PCN having new control values that have been varied, for example, by adding, to the original control value of the note-on timing included in the detected input "note-on message", respective deviation values of the player channels PC1–PCN having mutually different deviation states. In addition, the performance data output section 6 outputs predetermined "CCM-NRPNs" (those explained in relation to FIG. 3B) for the player channels PC1–PCN having new control values of delay vibrato start timing that have been varied, for example, by adding, to a predetermined value of the delay vibrato start timing (normally, predetermined standard value of the delay vibrato start timing or zero value with no delay vibrate imparted), respective deviation values of the player channels PC1–PCN having mutually different deviation states.

Note that the plurality of "note-on messages" output from the performance data output section 6 may include one or more note-on messages having the same control value as the input note-on message. Similarly, the plurality of "CCM-NRPNs" output from the performance data output section 6 may include one or more CCM-NRPNs having a zero control value of the delay vibrato start timing.

If arrangements are made to cause the "CCM-NRPN" of FIG. 3C to be output before the "note-on message", control can be performed on the delay vibrato start timing of notes following the note to be sounded in response to the "note-on message". Thereafter, each time the same combination "note-on message" plus "CCM-NRPN" is output or a "CCM-NRPN" alone is output, variation is imparted to the delay vibrato start timing.

Note that the "CCM-NRPNs", uniformly controlling tone characteristics of all notes to be processed by the individual player elements, further controls the individual notes controlled by the note-on messages.

Any other type of "CCM-NRPM" for controlling another note controlling parameter to control another tone characteristic, such as tone volume or vibrato velocity may be output, in place of the delay vibrato start timing illustrated in FIG. 3C, along with a "note-on message", so as to simultaneously output performance data deviated from a predetermined value each time a "note-on message" is detected.

Alternatively, a "polyphonic key pressure message" may be used, in place of the "CCM-NRPM", to designate a note number of a note to be sounded in response to a "note-on message", so as to output performance data for controlling a tone characteristic of the note. Because the "polyphonic key pressure message" is intended to control a note being sounded, the "polyphonic key pressure message" is output after a "note-on message".

In the illustrated example of FIG. 3C, when a "note-on message" is input, not only note-on messages but also other performance data (CCM-NRPMs) are output. Specifically, in the illustrated example of FIG. 3C, a note-on message (note controlling performance data) and other performance data (CCM-NRPMs) are output together, which is substantially equivalent to a case where two note controlling performance data are output together. In an alternative, however, there may be output two performance data defined as a single combination of two performance data, instead of the two performance data separately. In this case too, the two note controlling performance data are output together as if they were single performance data. In this way, even a parameter originally generated as a tone generator setting parameter can be controlled in its control value per note sounded in response to a note-on message, and therefore the parameter is reliably allowed to function in much the same way as a note controlling parameter.

Whereas the MIDI standard has limitations on defining of new performance data, any new performance data may be employed, as desired, if an original standard is employed.

Further, whereas, in the illustrated example of FIG. 3C, the input "note-on message" is processed to cause the original value included therein to be output for direct use for the player channels PC1–PCN, the other note controlling performance data may be processed to have a different control value for each of the player channels PC1–PCN, as a special specific example of FIG. 3C.

Of the above-described various note controlling parameters and tone generator setting parameters, what is considered to have the greatest influence on an ensemble feeling is variation in note-on timing among the player channels PC1–PCN.

Therefore, the following paragraphs describe a specific example where only note-on timing is varied among the player channels PC1–PCN. Tone signals to be performed at given timing in accordance with performance data of the individual players are output at a same tone pitch (in unison).

Figure 4:
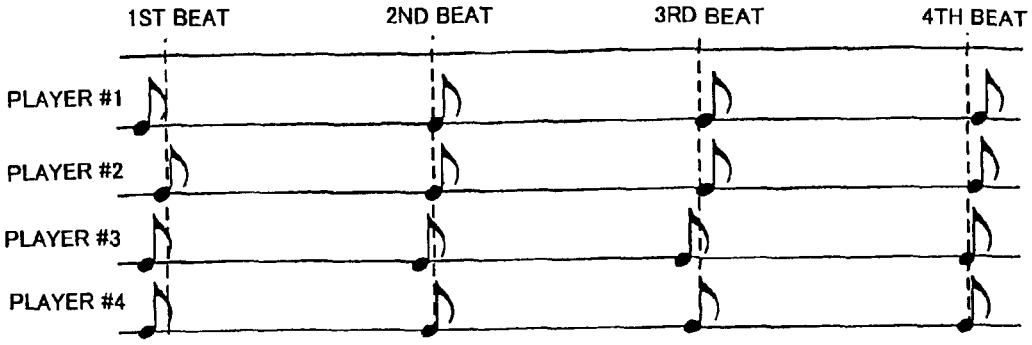
FIG. 4 is a first diagram showing measurements of deviations in note-on timing when acoustic violins are performed by a plurality of players.

FIG. 4 is a first explanatory diagram showing measurements of deviations in note-on timing when acoustic violins were performed as an ensemble by four players, players #1–#4; specifically, in the illustrated example, eighth notes are performed in succession for four beats at a performance tempo "120".

In FIG. 4, vertical lines represents normal note-on timing positions of the beats, and the notehead center of each eighth note performed by each of the players #1–#4 is shown as a measured actual note-on time position of the player.

In the illustrated example of FIG. 4, the note-on time positions of the first to fourth beats are deviated from the respective normal note-on timing positions differently among the players.

Measured actual note-on time positions of the player #1 have relatively great deviations from the respective normal note-on timing positions, and measured actual note-on time positions of the player #2 have relatively small deviations from the respective normal note-on timing positions. Measured actual note-on time positions of the player #3 and player #4 are always earlier than the respective normal note-on timing positions, and thus present negative deviations from the respective normal note-on timing positions. Namely, the measurements shown in FIG. 4 indicate different character of the four players.

Generally, for all of the players #1–#4, the actual note-on time positions (ensemble performance note-on time positions) of the first note immediately after the start of the performance tends to be earlier than the normal note-on timing; besides, there is relatively great variation or difference in the actual note-on time position of the first note among the players #1–#4. It can also bee seen from FIG. 4 that, as the performance progresses to subsequent notes, the actual ensemble performance note-on time positions tend to agree with the respective normal ensemble performance timing, and the variation in the measured note-on time position among the players #1–#4 becomes smaller. It can also bee seen from FIG. 4 that the actual note-on time positions of the third note tend to be earlier than the normal note-on timing like that of the first note.

Namely, from FIG. 4, it can been seen that the deviations in the actual note-on time position, from the normal note-on timing, of the players #1–#4 vary in accordance with the positions, within a phrase, of the notes after the start of the music piece. Even in the course of the ensemble performance, tendencies similar to the above-mentioned tendencies in the beginning portion of the performance were found after a rest of a predetermined time (i.e., predetermined silent time interval) after a preceding note.

Such a rest or silent time interval that can be considered to be similar to the performance beginning portion is greater than hundreds of milliseconds and is influenced only slightly by the performance.

Figure 5:
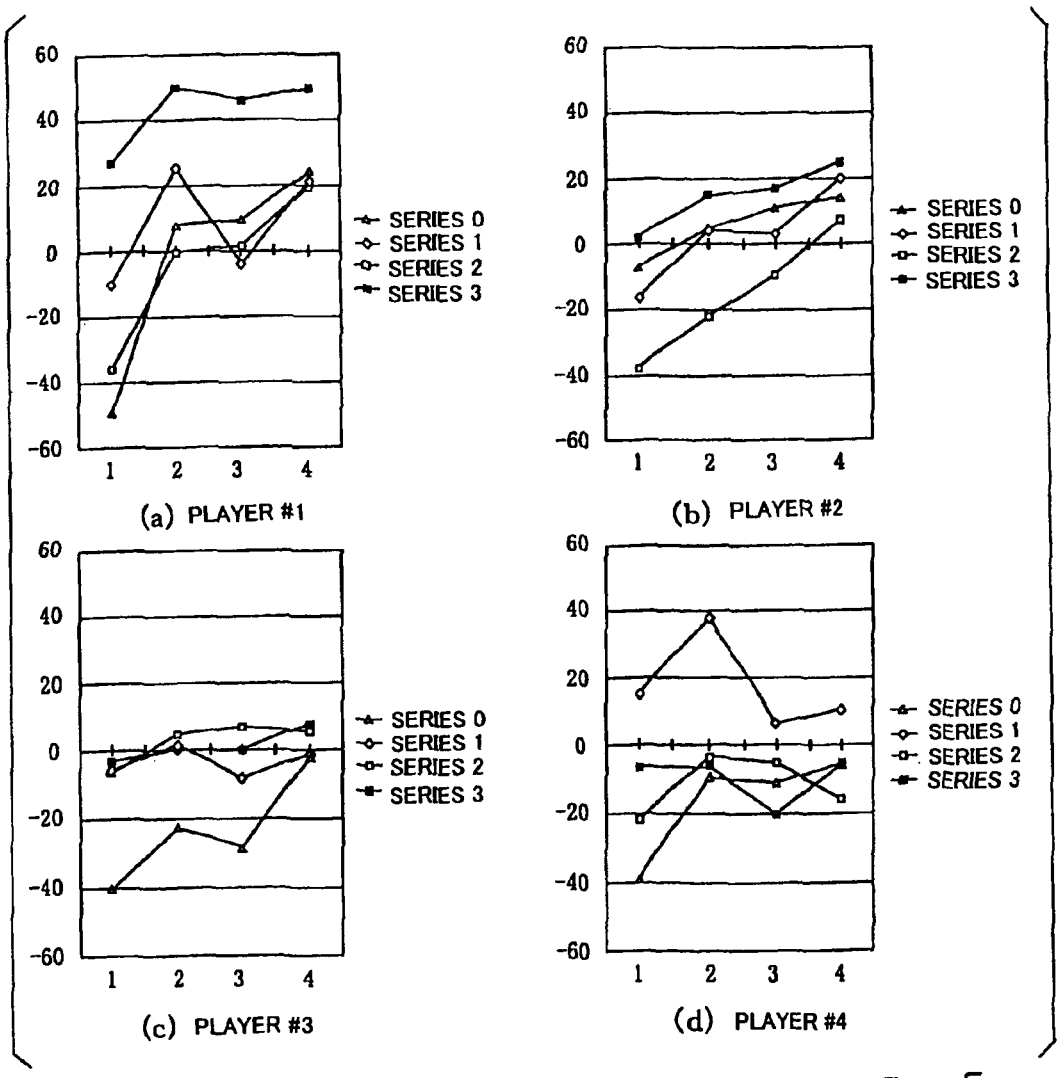
FIG. 5 is a second diagram showing measurements of deviations in note-on timing when acoustic violins are performed by a plurality of players.

FIG. 5 is a second explanatory view showing measurements of deviations in the actual note-on time position among the players #1–#4 when acoustic violins were performed by the players #1–#4.

In FIG. 5, the vertical axis represents a value of deviation (ms) where normal note-on timing of each beat, as specified on a musical score, is represented by a value "0", and each positive value represents a delay while each negative value represents a deviation value (ms) from the "0" value of the correct note-on timing as specified on the musical score. The horizontal axis represents respective timing of four eighth notes. Time interval between adjacent eighth notes is 500 ms.

Performance conditions in FIG. 5 are the same as in the example of FIG. 3, and FIG. 5 shows measured results of a plurality of takes obtained by executing the same performance a plurality of times.

Sections (a)–(d) of FIG. 5 show note-on time deviations among the individual players #1–#4. Series 0–3 in each of sections (a)–(d) represent series numbers of the individual takes. Note that FIG. 4 shows, along the time axis, the take of series number 0 among those illustrated in sections (a)–(d) of FIG. 5.

From the figure, it can be seen that, even for a same player, deviations in note-on time greatly vary among the takes.

Sets of the measurements of the note-on time deviations in the ensemble performance by the plurality of players, as shown in FIG. 5, are formed into "timing sequences" directly or after performing some processing.

The deviation value setting section 5 of FIG. 1 prestores the above-mentioned timing sequence in a storage device, such as a ROM.

Because the deviation values are varied in accordance with arranged order (time-serial order), within a phrase, of notes from the start of a performance, the deviation values of note-on timing are set by being switched over to other deviation values each time one of the notes within the phrase is detected. Even in the course of the ensemble performance, a point following a silent time interval greater than a predetermined time length is considered to be the beginning of a new phrase.

Therefore, the note-on timing of a "note-on message", output as an algorithm for achieving variation among the individual players in the deviation values of the note-on timing, provides deviation values on the basis of the input note-on timing, and the deviation values are varied each time a note is detected and are reset to those of the first note each time a phrase is initiated.

Such an ensemble performance by the plurality of players are measured a plurality of times, and a timing sequence (a plurality of takes) are stored for each of the players. When the user selects a desired total number of players, he or she also selects and uses a specific number of the timing sequences (a plurality of takes) corresponding to the selected total number of players.

However, because the ensemble feeling would also vary depending on the total number N of players, it is desirable that the measurements be obtained through execution of an actual performance for each of possible total numbers N of players. At that time, characteristics of the measurements obtained through the execution of the actual performance by a predetermined number of players may be analyzed and processed as necessary, so as to create "timing sequence" data for each of the possible total numbers N of players.

Because the timing deviation values vary among the takes, "player's timing sequence" data are prestored for a plurality of takes, such as series 0–series 3 of FIG. 5. As a performance of a music piece processes, a switchover is made between the takes in predetermined order or randomly each time a new phrase is detected.

Because the ensemble feeling can be obtained through interaction among a plurality of players performing together as a unit, the player's timing sequence to be used for each of the individual player channels PC1–PCN may be of a same deviation value series (same take).

In an alternative to the above-described selection scheme, there may be prestored one take of measurements of an actual performance, for each of phrase types classified according to the characteristic pattern of phrases, so that any suitable one of the takes can be selected and used in accordance with the phrase type detected by the performance data detection section 4.

Note that the necessary number of deviation values within each timing sequence is equal to the number of notes within a phrase. However, as known, the number of notes within a phrase differs among music pieces.

For example, every phrase is not necessarily made up of four notes. Where phrases are each made up of three or less notes, the timing sequence only has to be reset to an initial value upon completion of one phrase. However, for a relatively long phrase made up of four or more notes as well, supply of sequence data has to be continued.

Figure 6:
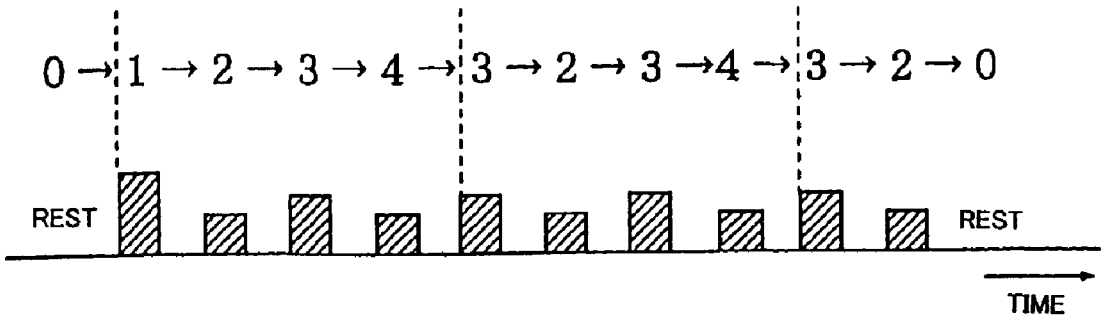
FIG. 6 is a diagram explanatory of how a timing sequence is used for a relatively long phrase.

FIG. 6 is a diagram explanatory of how a timing sequence is used for a relatively long phrase.

Let it be assumed here that one phrase of the timing sequence has four notes, and identification numbers of deviation values for respective normal note-on timing of first to fourth notes are represented by the same numbers as the notes. FIG. 6 illustratively shows a given take (train of deviation values), where deviation values are varied like "1→2→3→4→3→2→3→4→3" in response to the individual notes within the phrase.

In the figure, hatched blocks represent ordinary strength and weakness of beats in an ordinary music piece; namely, the first beat is the strongest, the third beat is the second-strongest, and the second and fourth beats are weak.

As explained previously with reference to FIGS. 4 and 5, particularly great deviation values are applied to a first note at the beginning of a music piece and a first note immediately following a rest, and therefore it is undesirable that the note-on time deviation values are reused midway through the phrase. Also, the phrase has strength and weakness of beats as illustrated in FIG. 6, and it can be estimated, from the actual measurements of FIG. 5, that note-on time deviations are influenced by the strength and weakness of beats. For these reasons, the note-on time deviation values are reused midway through the phrase with the strength and weakness of beats too taken into account; the timing sequence of FIG. 6 represents results of such reuse of the note-on time deviation values.

The explanations given above concern setting of the player characters as illustrated in FIG. 2. The player characters are further adjusted by the player character modifying values. Namely, the deviation values based on the actual measurements can be adjusted in accordance with player character modifying values designated by the user.

There is a tendency for the note-on timing deviation values to become small as the performance tempo increases. Therefore, a timing exaggeration coefficient value $k_1$, which can be said to be a modifying or qualifying value of the note-on time deviation rate, can also be controlled in accordance with the performance tempo.

Figure 7:
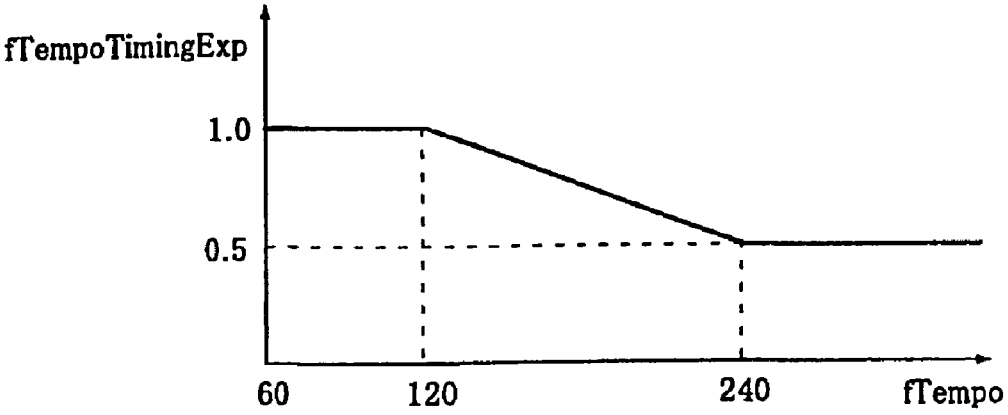
FIG. 7 is a graph illustrating relationship between a performance tempo and note-on timing exaggeration coefficient value.

FIG. 7 is a graph illustrating relationship between the performance tempo (fTempo) and note-on timing exaggeration coefficient value $k_1$ (fTempoTimingExp), where two bend points are provided.

For each performance tempo in a range of 60–120, the note-on timing exaggeration coefficient value $k_1$ is set to "1". As the performance tempo increases toward another range of 120–240, the note-on timing exaggeration coefficient value $k_1$ is gradually decreased to "0.5". For each performance tempo beyond "240", the note-on timing exaggeration coefficient value $k_1$ is kept at "0.5".

The preceding paragraphs have described the case where the deviation value setting section 5 stores, as the deviation values, measured note-on time deviations in an actual ensemble performance executed by a plurality of players. In this case, realistic note-on timing deviations can be obtained because they are based on the actual measurement. However, this approach would take a long time for the actual measurement and require a great storage capacity.

Therefore, a description will be given about a scheme in accordance with which deviations to be applied to control values are given using random numbers. This scheme can eliminate the need to obtain and store a multiplicity of measured data, although it may reduce reality of an ensemble feeling.

Figure 8:
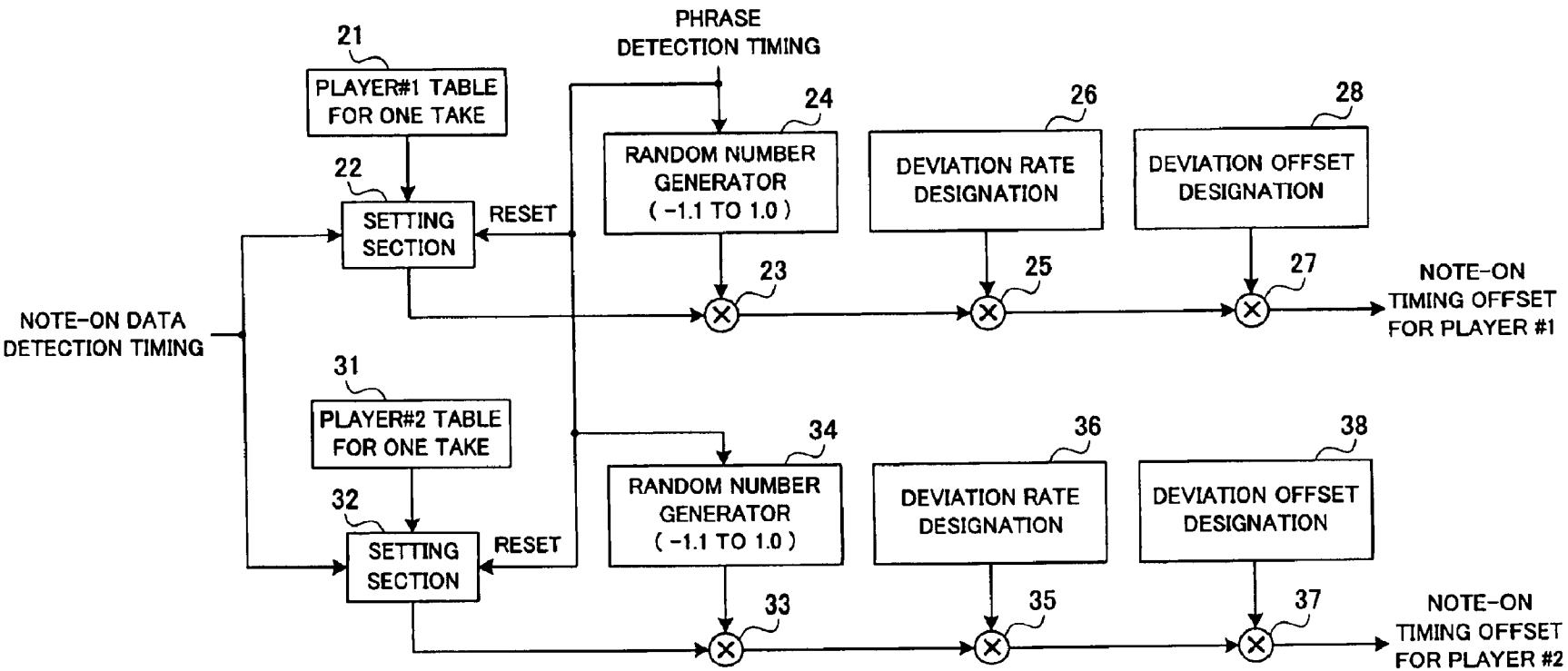
FIG. 8 is a block diagram showing arrangements for providing deviations to a note controlling parameter using random numbers.

FIG. 8 is a block diagram showing arrangements for providing deviations to a note controlling parameter using random numbers and measured data of one take.

The illustrated example of FIG. 8 includes a table for player #1 21 and a table for player #2 31, which together constitute a timing sequence table for one take (train of deviation values) based on actual measurements. The illustrated example also includes setting sections 22 and 23, multipliers 23 and 33, random number generators 24 and 34, multipliers 25 and 35, deviation rate designation sections 26 and 36, adders 27 and 37, and deviation offset designation sections 28 and 38.

Once given note controlling performance data (in the illustrated example, "note-on message") is input and detected for the first time, the setting sections 22 and 23 each reset a readout location of the player #1 table 21 or player #2 table 31 to an initial position and sets a first deviation value corresponding to a first note. At the same time, the setting sections 22 and 23 each update an output from the corresponding random number generator 24 or 34.

Each time a "note-on message" is detected, the setting sections 22 and 23 each advance the readout location of the corresponding player #1 table 21 or player #2 table 31, to thereby output a deviation value of the note-on timing.

To simplify the description, let's assume here that phrase detection time data (i.e., data indicative of a detected time of a phrase) is input immediately before note detection time data (i.e., data indicative of a detected time of a note). Each time the phrase detection time data is input, the setting sections 22 and 23 each reset the readout location of the player #1 table 21 or player #2 table 31 to the initial position. If the phrase in question contains a great number of notes, a portion of a plurality of deviation values is read out repetitively in a pattern as shown in FIG. 6.

Output from the setting section 22 is passed to the multiplier 23, where it is multiplied by an output (value in a range of values −1 to 1) from the random number generator 24. Values stored in the player #1 table 21 represent maximum note-on timing deviation values of the individual notes, and values smaller than such maximum note-on timing deviation values can be provided by random numbers with signs as will be described.

The random number generator 24 updates its output each time a phrase is detected, and this means that the random number generator 24 generates a deviation state different from that of the first take. Stated differently, the values stored in the player #1 table 21 can be said to be "weighting coefficients" for deviations of the notes within the phrase, which are given to the random numbers for each take.

Output from the multiplier 23 is sent to the multiplier 25, where it is multiplied by an output from the deviation rate designation section 26. Then, an output from the multiplier 25 is added by the adder 27 to an output from the deviation offset designation section 28, so as to produce a note-on deviation value for player #1. In an alternative, the order of the arithmetic operations by the multiplier 25 and adder 27 may be reversed; that is, the multiplication by the multiplier 25 may be performed after the addition by the adder 27.

Note-on timing deviation value for player #2 is obtained in a similar manner to the note-on timing deviation value for player #1. If a desired ensemble performance is to be executed by three or more players, note-on timing deviation values for the other players than players #1 and #2 are obtained in a similar manner to the note-on timing deviation value for player #1.

Alternatively, the random number generators 24 and 34 may be replaced with only one random number generator which can sequentially output random numbers for all of the players in a distributive manner. Further, the player #1 table 21 and player #2 table 31 may be replaced with a number of player tables, in which case the user can select any of the player tables to be used for player #1 and player #2.

To enhance the reality of the feeling of the ensemble, the above-described example of FIG. 8 uses a player table for each player which stores at least one take (train of deviation values) based on actual measurements.

To simplify the construction, the player #1 table 21 and player #2 table 31 may be replaced with random number generators that are provided in corresponding relation to the players so as to provide different deviation states to the corresponding players so that deviations values varying among the players are imparted to the note-on timing of each of the notes within the phrase. At that time, it is desirable that the absolute value of the variation range be smaller than the random numbers output from the random number generators 24 and 34.

To further simplify the construction, there may be used a different fixed value for each of the players, in place of the player #1 table 21 and player #2 table 31. In such a case, the random number generators 24 and 34 may update their outputs not only in response to input of the phrase detection time data but also in response to input of "note-on message" detection time data, so as to vary the note-on timing deviation values of each note in the phrase. At that time, it is desirable that the absolute value of the variation range be smaller than the variation range of the random numbers to be generated in response to input of the phrase detection time data.

The preceding paragraphs have described the functions of the performance data processing system practicing the performance data processing data of the present invention; however, the performance data processing section 2 shown in FIG. 1 may be implemented in any of various forms.

Figure 9A:
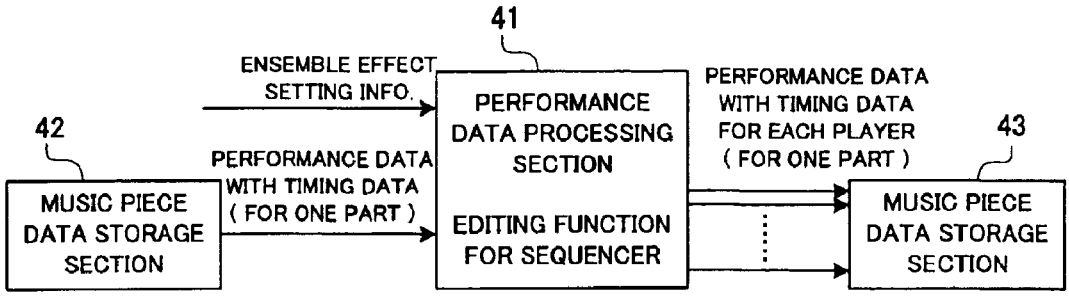
FIGS. 9A–9C are diagrams showing a first specific embodiment of the performance data processing method of the present invention.
Figure 9B:
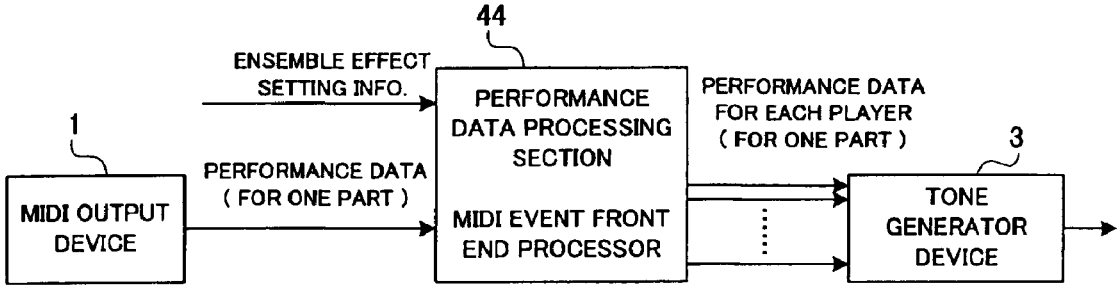
Figure 9C:
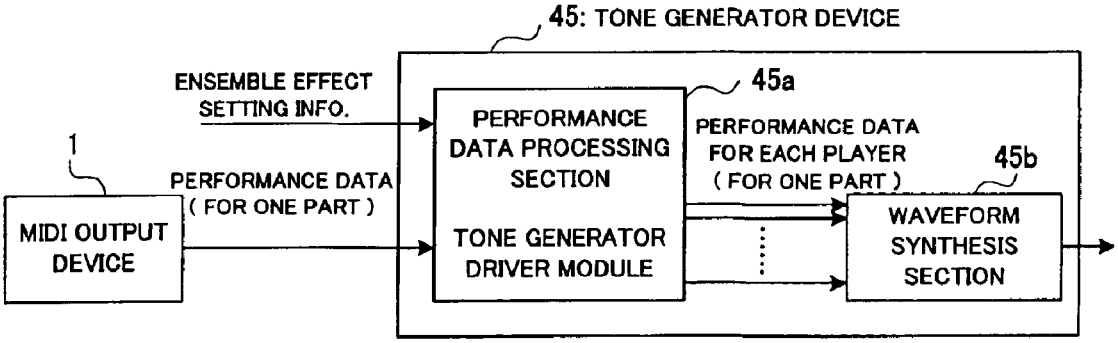

FIGS. 9A–9C are diagrams explanatory of one specific example of the performance data processing method of the present invention. FIG. 9A is a diagram explanatory of a specific example where the present invention is embodied as an editor in a sequencer. FIG. 9B is a diagram explanatory of an example where the present invention is embodied as a front end processor of MIDI events. FIG. 9C is a diagram explanatory of an example where the present invention is embodied as a tone generator driver module.

In FIG. 9A, music piece data storage sections 42 and 43 are, for example, in the form of a built-in memory or external storage device of an electronic musical instrument or personal computer that runs sequencer software.

Performance data processing section 41 reads out performance data accompanied with timing data from a music piece data file, such as an SMF (Standard MIDI File) stored in the music piece data storage section 42.

The performance data may be in any desired format, such as: the "event plus relative time" format where the time of occurrence of each performance event is represented by a time length from the immediately preceding event, as in the case of an SMF; "event plus absolute time" format where the time of occurrence of each performance event is represented by an absolute time within the music piece or measure thereof; "pitch (rest) plus note length" format where each performance data is represented by a pitch and length of a note or a rest and a length of the rest; "solid" format where a memory region is reserved for each minimum resolution of a performance and each performance event is stored in one of the memory regions that corresponds to the time of occurrence of the performance event; or other original format of sequencer software.

The performance data processing section 41 outputs performance data for the players, in order to impart an ensemble effect to the input performance data. The performance data thus output from the performance data processing section 41 are also accompanied by timing data. For example, performance parts and player elements may each be identified by a MIDI channel number.

Once a "note-on" message is input, the timing data of note-on messages to be output for the individual players are each determined by, for example, adding deviation values, varying among the players, to the original timing data value of the input note-on message. In the case where event timing is designated by a relative time, different relative times are calculated in accordance with respective event timing at which a plurality of note-on messages are to be output for the players.

Performance data stored in the music piece data storage section 43 is read out from the storage section 43 and output to the tone generator device, during or after completion of processing of corresponding music piece data, to synthesize tone signals.

In the case where the music piece data storage section 43 is in the form of an external storage device, such as a magnetic hard disk or semiconductor memory card, the performance data is stored in a track corresponding to the channel number of the input performance data. Performance data of individual player elements of individual performance parts may be stored together in a same track.

The music piece data storage sections 42 and 43 may be implemented by a same hardware device. The user may decide to store performance data, having been processed, in different storage regions, or delete performance data before processed.

Because the process is not a real-time process, there is not produced a particular inconvenience even if the note-on timing of the "note-on messages" to be output becomes earlier than the original note-on timing of the input "note-on message" by being multiplied negative deviation values. Further, settings of an ensemble effect in the phrase in question may be controlled after identifying the type of the phrase.

Next, a description is given about the example of FIG. 9B where the present invention is embodied as the MIDI event front end processor.

The MIDI output device 1 is, for example, an external MIDI keyboard or electronic musical instrument, which outputs, as performance data, real-time MIDI data accompanied with no timing data. The MIDI output device 1 may be connected with the performance data processing section 44 via a connecting cable, or via a communication network, such as a LAN or the Internet.

The performance data processing section 44 outputs performance data for all of the players, in order to impart an ensemble effect to the performance data input from the MIDI output device 1. The performance data to be output from the performance data processing section 44 are MIDI data accompanied with no timing data. For example, each performance part and player may be identified by a MIDI channel number.

The tone generator device 3 assigns the performance parts and players in accordance with the MIDI channel numbers and thereby synthesizes tone signals for the individual players. Because a real-time process is carried out here, the note-on timing of the "note-on messages" to be output may become earlier than the note-on timing of the "note-on message", in which case it is necessary to permit a predetermined processing delay. In an alternative, negative time-serial offset values may be changed uniformly to "0" in order to maintain the real-time processing capability.

The above also applies to a case where the MIDI output device 1 is replaced with a keyboard of an electronic musical instrument having the performance data processing section 44 incorporated therein and where performance data output from the keyboard are used for a performance. In this case, the performance data need not be MIDI data and may be in the form of signals used within the electronic musical instrument.

Similarly, if the tone generator 3 is also incorporated in the electronic musical instrument, the performance data to be output from the performance data processing section 44 too may be in the form of signals used within the electronic musical instrument.

Where the performance data processing section 44 is arranged to generate performance data accompanied with timing data, the performance data can be output to the music piece data storage section 43 as shown in FIG. 9A.

Next, a description is given about the example of FIG. 9C where the present invention is embodied by providing a performance data processing section 45*a* within a tone generator device 45.

The MIDI output device 1 outputs, as performance data, real-time MIDI data accompanied with no timing data or signals to be used within an electronic musical instrument.

The performance data processing section 45*a* operates as a tone generator driver module within the tone generator device 45. Format of the performance data to be output from the performance data processing section 45*a* may be determined independently of the format of the performance data input from the MIDI output device 1. The performance data processing section 45*a* transfers a note controlling parameter or tone generator setting parameter to a waveform synthesis section 45*b*.

In this case too, some processing delay would be involved because the MIDI output device 1 outputs MIDI data in real time, and thus negative time-serial offsets may be changed to "0" to achieve real-time processing.

Figure 10:
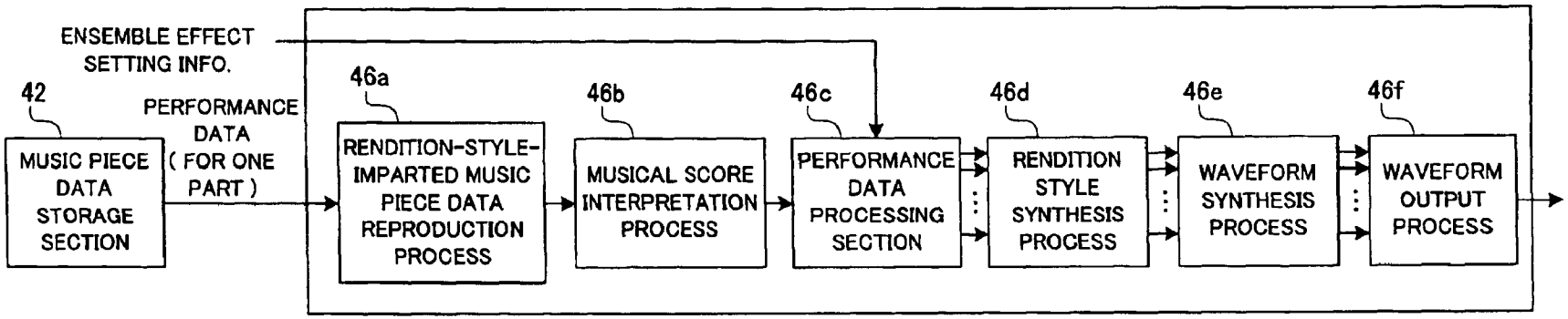
FIG. 10 is a diagram showing a second specific embodiment of the performance data processing method of the present invention.

FIG. 10 is a block diagram showing a second specific embodiment of the present invention, which is embodied as a tone generator driver module within a playback tone generator.

The "playback tone generator" is a tone generator which executes an event process ahead of actual tone generation timing. Specifically, the "playback tone generator" is a tone generator which is supplied in advance with information indicating when a currently-generated tone (currently-sounded note) is to end and when a next tone (next note) is to start and thereby can achieve any of various rendition styles (articulation) with no regard to the law of cause and effect. Such a "playback tone generator" is disclosed, for example, as a "waveform generation apparatus" in Japanese Patent Laid-open Publication No. 2001-100758.

In FIG. 10, reference numeral 46 represents a playback tone generator device, 46*a* a reproduction processing section for reproducing rendition-style-imparted music piece data, 46*b* a musical score interpretation processing section, 46*c* a performance data processing section, 46*d* a rendition style synthesis processing section, 46*e* a waveform synthesis processing section, and 46*f* a waveform output processing section.

Music piece data storage section 42 stores therein rendition-style-imparted music piece data. Rendition styles described on a musical score as musical signs and marks, such as dynamics marks, tempo marks and slur marks, are recorded as rendition style signs in MIDI sequence data.

The rendition-style-imparted music piece data reproduction processing section 46*a* reproduces input rendition-style-imparted music piece data. The musical score interpretation processing section 46*b* interprets arrangement of musical signs and marks and notes on the musical score, converts the interpreted arrangement of musical signs and marks and notes into performance data, and then outputs the performance data to the performance data processing section 46*c* alone with time information. Concurrently, the musical score interpretation processing section 46*b* also outputs conventional MIDI data along with time information.

The performance data processing section 46*c* is a function module constructed as a specific embodied example of the performance data processing method of the present invention. Therefore, ensemble effect settings for all of participating players are made in advance in the performance data processing section 46*c*. The performance data processing section 46*c* receives note controlling performance data or tone generator setting performance data, having been subjected to the musical score interpretation process, and then outputs note controlling performance data or tone generator setting performance data for all of players. The note controlling performance data or tone generator setting performance data to be output from the performance data processing section 46*c* are imparted with deviations from the input control value.

The rendition style synthesis processing section 46*d* generates rendition style designating information on the basis of the performance data input for each of the player channels, refers to a rendition style table in accordance with the rendition style designating information, and thereby generates packet-related vector parameters which correspond to a packet stream (vector stream) and rendition style parameters. Then, the rendition style synthesis processing section 46*d* outputs the thus-generated vector parameters to the rendition style synthesis processing section 46*e*. For a pitch element and amplitude element, the packet stream includes time information of packets, vector ID, representative-point value series, etc. For a waveform shape element, the packet stream includes a vector ID, time information, etc.

The waveform synthesis processing section 46*e* retrieves vector data from a code book in accordance with the packet stream, modifies the retrieved vector data in accordance with the vector parameters, and synthesizes a tone waveform on the basis of the thus-modified vector data.

The waveform output processing section 46*f* additively synthesizes synthesized tone waveforms of the individual players. If a waveform is synthesized, via a conventional real-time tone generator (not shown), for performance data of another performance part, the waveform is additively synthesized with the tone waveforms of the individual players so that the synthesized result is set as an ultimate output from the waveform output processing section 46*f*.

In this embodied example of FIG. 10, no real-time process is executed, so that there is not produced a particular inconvenience even if the note-on timing of the input "note-on messages" to be output becomes earlier than the note-on timing of the "note-on message". Further, settings of an ensemble effect in the phrase can be controlled after identifying the type of the phrase.

The preceding paragraphs have described a plurality of specific embodiments of the inventive performance data processing method with reference to FIGS. 9A–9C and 10.

The above-described performance data processing sections 41 and 44 may be implemented by a CPU (Central Processing Unit) of a personal computer executing a software program. In this case, the program is made as an application program to be executed under control of an operating system program. The thus-made program is recorded on a recording medium, installed in the personal computer and executed by the CPU of the personal computer.

As a modification, the present invention may be implemented as a sequencer apparatus or a dedicated electronic musical instrument having a sequencer function, by designing an original hardware circuit board, having a CPU mounted thereon, similar in construction to the architecture of a personal computer and storing a dedicated program for controlling the CPU in a ROM.

Further, with the above-described performance data processing sections 41 and 44, a DSP (Digital Signal Processor) or CPU, which executes signal processing algorithms via a dedicated program, can be implemented as an IC (Integrated Circuit) chip corresponding in function to a tone generator IC.

Further, with the above-described performance data processing section 45*a* provided within the tone generator device 45 shown in FIG. 9C or with the above-described performance data processing section 46*c* shown in FIG. 10, the entire tone generator device 45 or playback tone generator device 46 can be implemented by a CPU of a personal computer executing a predetermined program, by an original hardware circuit board executing a dedicated CPU-controlling program stored on the circuit board, or by a DSP or CPU implemented as an IC-chip tone generator.

The following paragraphs describe a specific example of ensemble effect setting operation performed by the user in one embodiment of the inventive performance data processing method.

The user's ensemble effect setting operation is explained below as performed in the case where the present invention is embodied as the tone generator driver module of the playback tone generator device 46 shown in FIG. 10. Note, however, that the user's ensemble effect setting operation is also applicable to the case where the present invention is embodied as the sequencer editor, the case where the present invention is embodied as the MIDI event front end processor shown in FIG. 9B or the case where the present invention is embodied as the tone generator device shown in FIG. 9C.

Figure 11:
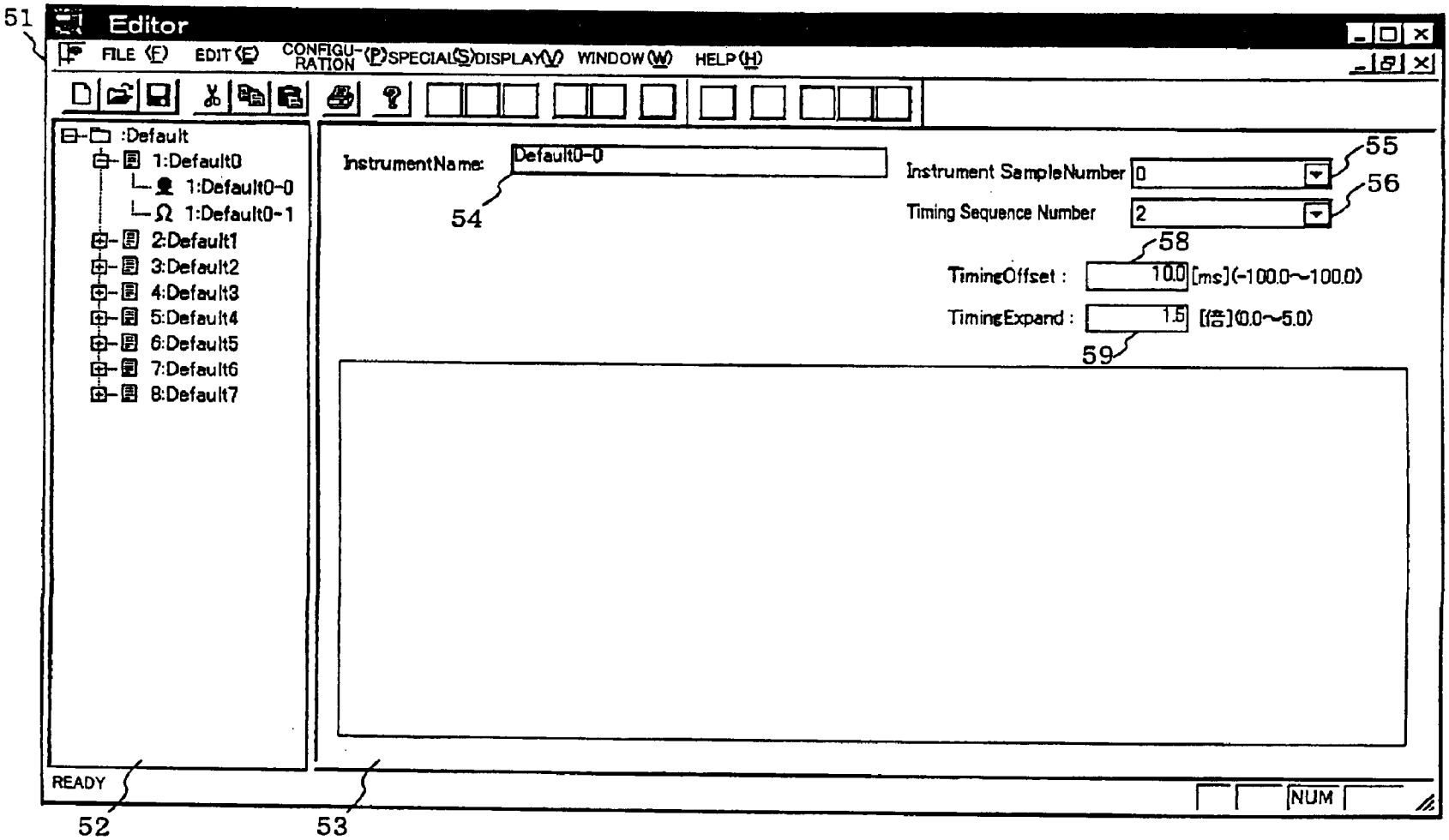
FIG. 11 is a diagram explanatory of a setting screen to be used for outputting performance data with an ensemble feeling.

FIG. 11 is a diagram explanatory of a setting screen to be used for outputting performance data with an ensemble feeling.

In the figure, reference numeral 51 represents the setting screen shown on a display of a personal computer, 52 represents a left pane (window) for displaying an organization of a band, and 53 represents a right pane (window) to be used for making settings for one player.

In the performance data processing apparatus, tone generator controlling parameters are managed as a band (performance). The performance (band) is defined hierarchically and editable by the user. Such hierarchical organization is displayed on the left pane 52.

The performance ("Default") comprises a plurality of parts "Default 0", "Default 1", "Default 2", . . . , "Default 7". One voice (musical instrument's tone color) is assigned to each of the parts. Examples of the voices assigned to the parts include first violin, second violin, viola, cello, contrabass, flute 1, flute 2, oboe 1, oboe 2, horn 1 and horn 2. Note that the part names enclosed by quotation marks are default names that can therefore be replaced with user-desired names.

One or more players (musical instruments) are allocated to a voice. "Default 0-0" and "Default 0-1" are the names of two players allocated to the voice "Default 0".

A plurality of players can be allocated to a "section voice". Only one player can be allocated to a "solo voice". In the illustrated example of FIG. 11, "Default 0" represents a section voice.

Once the user selects the player "Default 0-0" by performing clicking operation via a mouse button, a setting screen for the player "Default 0-0" is displayed on the right pane 53, which includes a player name (Instrument Name) display area 54. Reference numeral 55 represents a section for entering a "player tone color number (Instrument Sample Number)" designating a tone color of the player, 56 a section for entering a "timing sequence number" designating performance timing (performance action) of the player, 58 a section for entering a timing offset coefficient (Timing Offset), and 59 a section for entering a timing exaggeration coefficient (TimingExpand: hereinafter referred to as a "timing exaggeration coefficient value $k_2$").

In the illustrated example, there is employed a scheme of making settings of character of a player by setting a combination of a tone color of a musical instrument to be performed by the player and setting performing operation of the player.

Namely, character of a player is set by setting an independent combination of a "player tone color number (Instrument Sample Number) entered into the input section 55 to define a tone color of the player to be set and a "timing sequence number" entered into the input section 56 to define performance action of the player. Setting such independent combinations can increase the number of types of character.

Needless to say, the character of a tone color and performance action may be set simultaneously in response to entry of a "timing sequence number" alone. Note that the illustrated examples of FIGS. 1 to 10 having been described above are arranged to set character of both a tone color and performance action by use of a player channel number PC1–PCN.

In the case where an independent player channel number is used for each of the tone color and performance action as shown in FIG. 11, the note-on timing deviation value control determines deviation values in accordance with a "timing sequence number" pertaining to performance action.

For setting of note-on timing deviations, a set of timing sequences for a plurality of players is selected by a timing table number entered via a parameter setting screen (not shown), and a standard "deviation pattern" is designated by a "timing sequence number" and is modified with a timing offset coefficient and timing exaggeration coefficient value $k_2$ entered as "player character modifying values" via the input sections 58 and 59

By such modification, the standard "deviation pattern" can be adjusted in accordance with user's preference.

Note that, whereas setting operation may be performed on one or more other tone generator controlling parameters for a given player, it has no direct relation to the features of the present invention and thus will be not described or illustrated.

Figure 12:
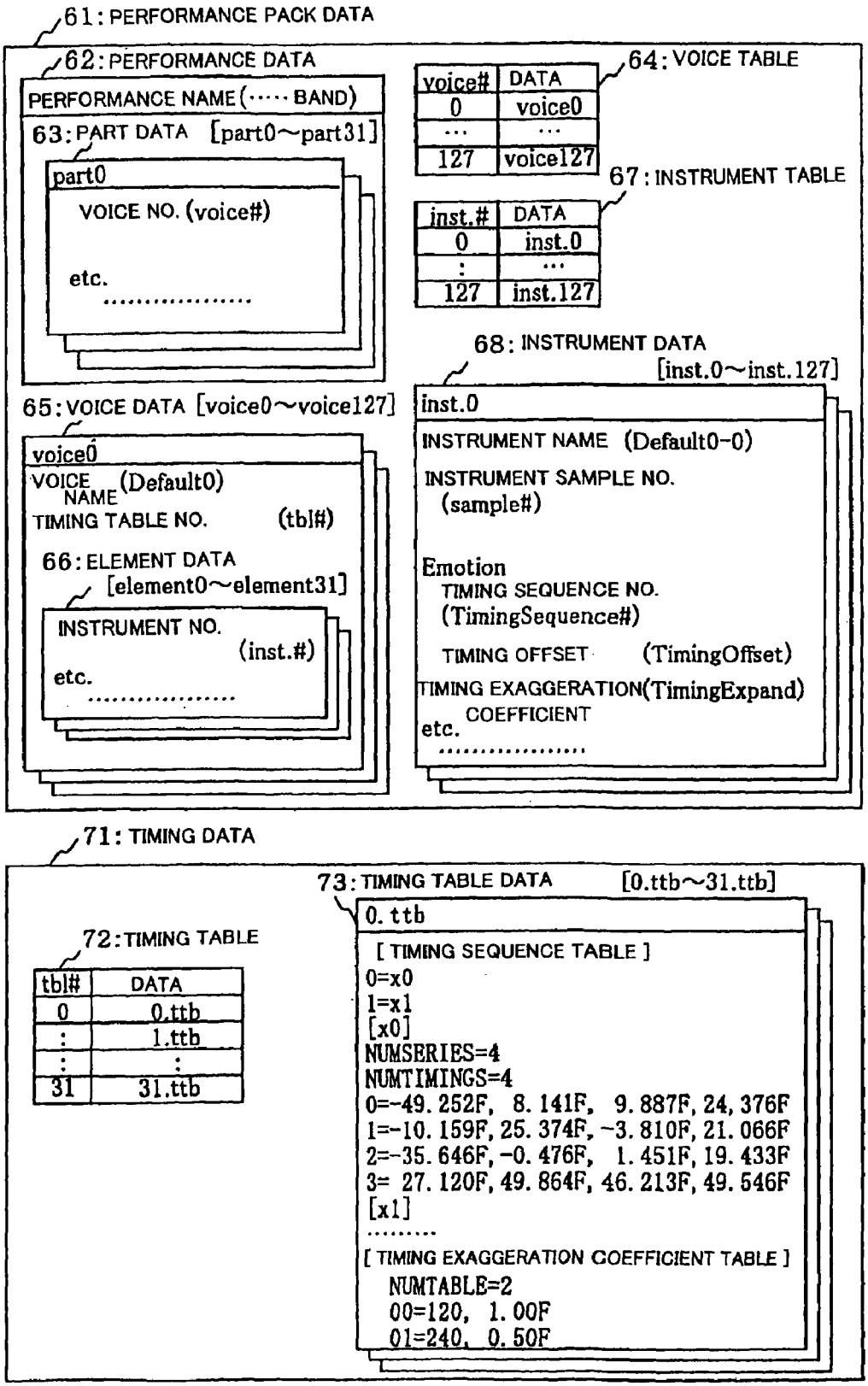
FIG. 12 is a diagram showing various parameters pertinent to the features of the present invention and relationship among the parameters.

The following paragraphs describe how the deviation value setting section 5 of FIG. 1 operates when player character etc. have been set as ensemble effect setting information. FIG. 12 is a diagram showing various parameters and relationship among the various parameters.

Parameters pertaining to a performance (band) are organized as performance pack data 61. FIG. 12 shows only parameters pertinent to the features of the present invention. Deviation values of note-on timing are combined into timing data 71.

Performance data 62 include data indicative of the name of the band and part data 63. The performance data 62 can include data of up to 32 parts, for each of which a voice number (voice#) is set in advance; the voice number is converted via a voice table 64 into voice data 65.

Illustratively describing the voice data of voice number "voice0" it includes data indicative of the name of the voice (Default0) and timing table number (tbl#), element data 66, etc. The voice data can include up to 32 element data 66, and an instrument number "inst.#" is set for each of the element data 66 and converted via an instrument table 67 into instrument data 68.

Illustratively describing the instrument data 68 of instrument number "inst.0", it includes data indicative of an instrument name, instrument sample number, timing sequence number, timing offset, timing exaggeration coefficient value $k_2$, etc. determined in accordance with "Default0-0, "sample#", "TimingSequence#", "TimingOffset", "TimingExpand", etc.

Here, the instrument sample number, timing sequence number, timing offset, timing exaggeration coefficient value $k_2$ are designated by the user on the setting screen shown in FIG. 11.

The timing data 71, on the other hand, include a timing table 72 and timing table data 73.

Timing table number (tbl#) in the voice data 65 is converted into timing table data 73 via the timing table 72. There are provided 32 different timing table data 73 ("0.tbl"–"31.tbl"), each of which includes a timing sequence table, timing exaggeration coefficient table, etc.

Referring to the timing table "0.ttb", a "timing sequence table" section converts a timing sequence number, designated by the user, into any one of "0=x0", "1=x1", . . . , "31=x31". Whereas the timing sequences of only two players "x0" and "x1" are illustrated, there are, in practice, provided timing sequences of up to 32 players. Values "0"–"31" on the left term each represent the value of a timing sequence number of the instrument data 68; a "Timing Sequence Number" is designated by the left-term value in the illustrated example of FIG. 11. Each of the players " x0, "x1", . . . , "x32" has a specific number "NUMSERIES" of takes (train of deviation values) defined therefor. The player "x0" has four takes (take 0–take 3) (deviation value series).

Each of the takes constitutes a single timing sequence having deviation values representative of deviations from the tone generation timing of a specific number "NUMTIMINGS" of notes defined therein. How the deviation values of the timing sequence are used has already been described with reference to FIG. 6.

In a timing exaggeration coefficient table of the timing table data 73, there are stored timing exaggeration coefficient values $k_1$ corresponding to various performance tempo values as shown and described earlier in relation to FIG. 7; "NUMTABLE" represents the number of break points in the table which correspond to the bending points in FIG. 7. Numerical values "120", "1.00F", "240" and "0.50F" are read out from the table, and timing exaggeration coefficient values $k_1$ corresponding to various performance tempo values are stored in the manner as illustrated in FIG. 7.

The timing offset coefficients are not corrected in accordance with a performance tempo.

Respective timing table data of a plurality of voices belonging to a same musical instrument tone color may be put together into a single set of timing table data 73; for example, the respective timing table data of "trumpet 1" and "trumpet 2" may be put together into a single set of timing table data.

Further, respective timing table data of a plurality of voices may be put together into a single set of timing table data 73 in accordance with the category of the voices. For example, the respective timing table data of "trumpet 1", "trumpet 2", "trombone" and "synthesizer trumpet", belonging to the brass family, may be put together into a single set of timing table data.

Now, a detailed description will be given about timing processing using flow charts of FIGS. 13 and 14 and with reference to the parameters shown in FIG. 12.

Figure 13:
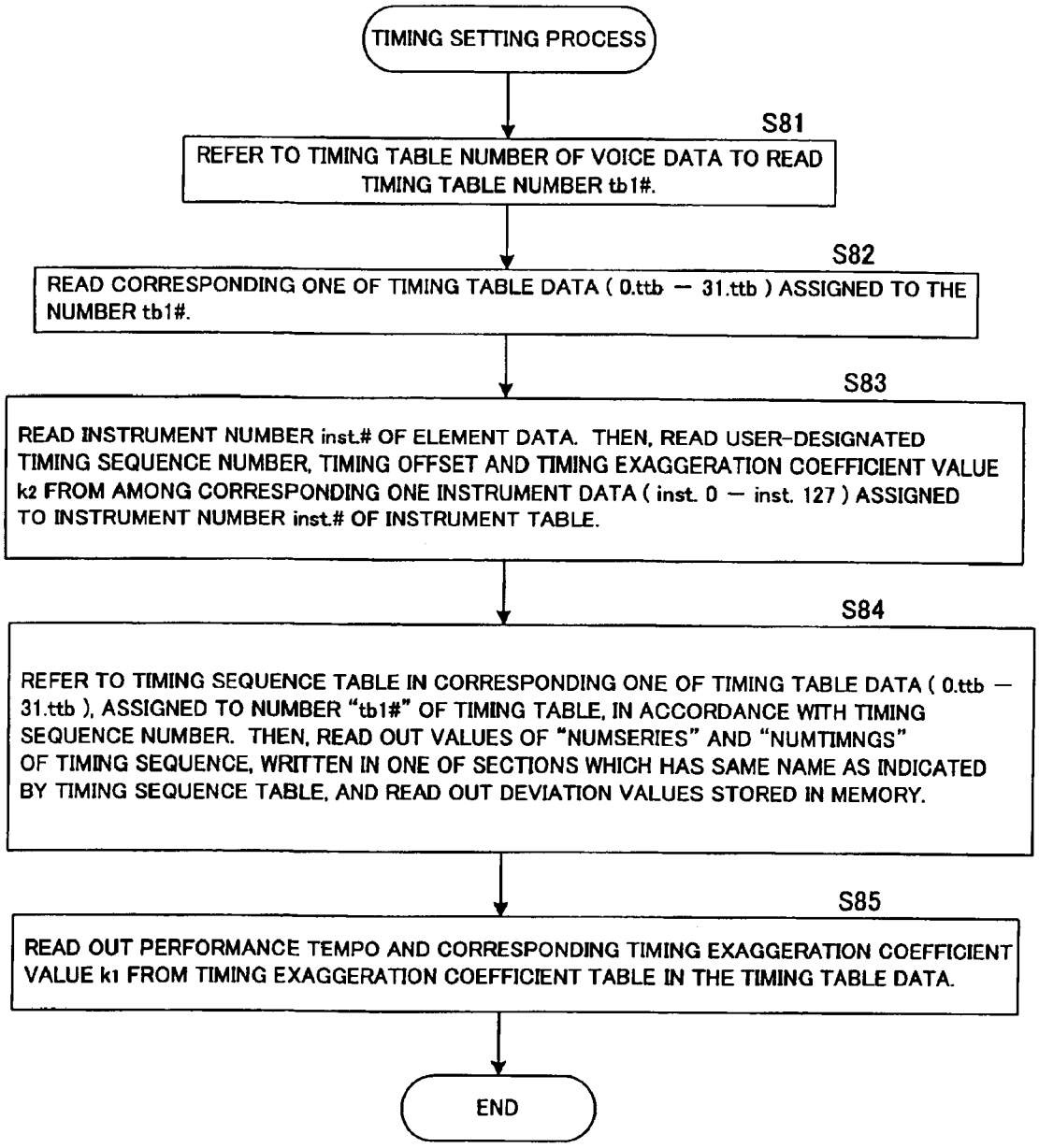
FIG. 13 is a flow chart explanatory of a timing setting process.

FIG. 13 is a flow chart explanatory of a timing setting process. First, at step S81, reference is made to the timing table number of the voice data 65 ("voice0" in the illustrated example of FIG. 12 to read the timing table number (tbl#).

At next step S82, the corresponding one of the timing table data 73 ("0.ttb"–"31.ttb") assigned to the number "tbl#" of the timing table 72 is read; FIG. 12 shows the contents of the timing table data "0.ttb".

At following step S83, the instrument number "inst.#" of the element data 66 is read, and a user-designated timing sequence number, timing offset and timing exaggeration coefficient value $k_2$ are read out from among a corresponding one of the instrument data 68 ("inst.0"–"inst.127") assigned to the instrument number "inst.#" of the instrument table 67; FIG. 11 shows the contents of the instrument number "inst.0".

At next step S84, reference is made to a timing sequence table in the corresponding one of the timing table data 73 ("0.ttb"–"31.ttb"), assigned to the number "tbl#" of the timing table 72, in accordance with the timing sequence number. Then, values of the numbers "NUMSERIES" and "NUMTIMNGS" of the timing sequence, written in a corresponding one of the sections "x0", "x1", . . . , "x32" which has the same name as a string of letters indicated by the timing sequence table, are read out, and deviation values are read out and stored in memory.

Note that "NUMSERIES" represents a total number of deviation value series; in the illustrated example of FIG. 12, there are provided four deviation value series (series 1–series 3), and hence NUMSERIES=4. Further, "NUMTIMNGS" represents a total number of notes (deviation values) in the timing sequence; in the illustrated example of FIG. 12, "NUMTIMNGS"=4. FIG. 12 shows the contents of the timing sequence of "sequence 0=x0".

Then, at step S85, a performance tempo and timing exaggeration coefficient value $k_1$ corresponding to the tempo are read out from the timing exaggeration coefficient table in the corresponding timing table data.

Figure 14:
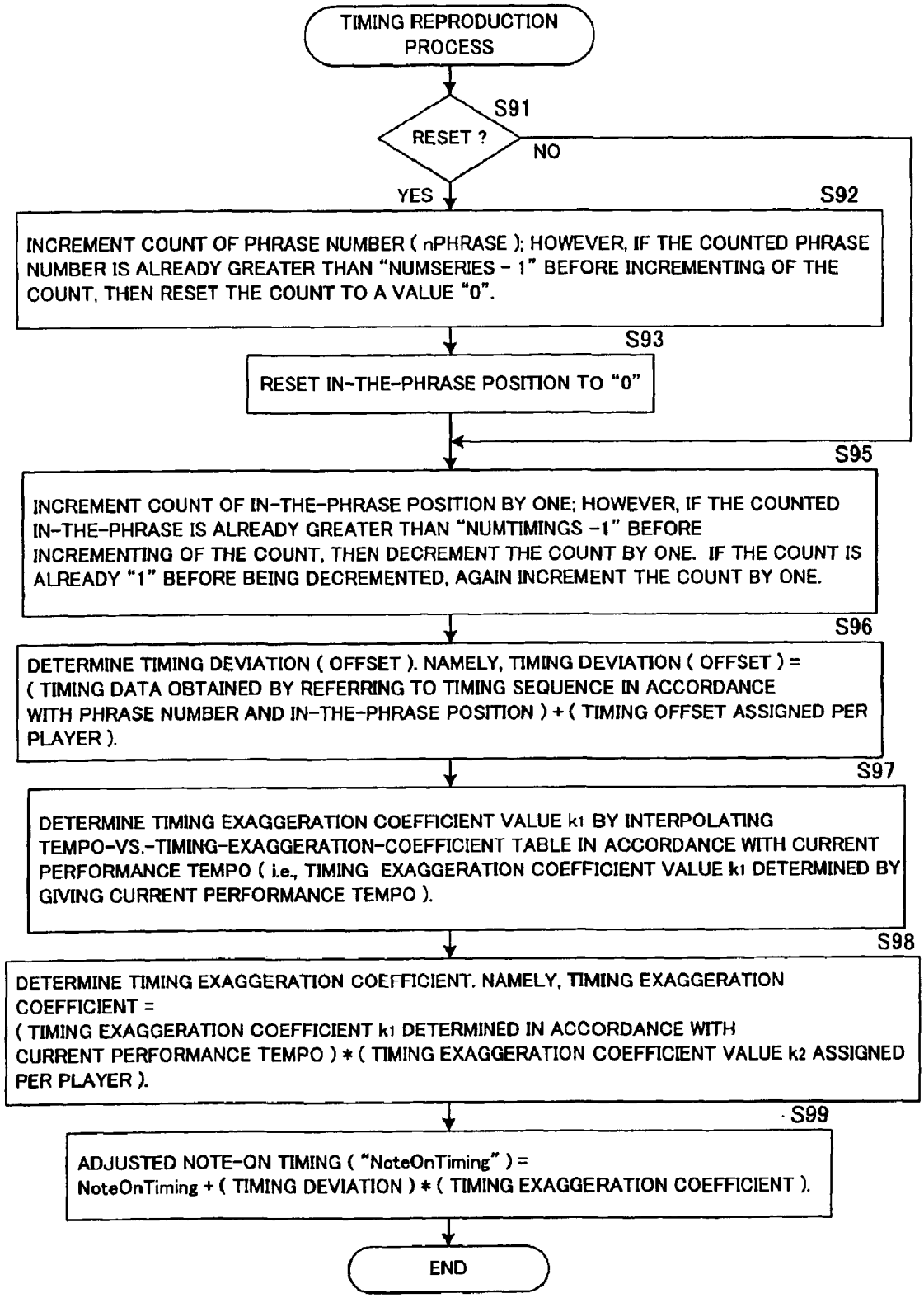
FIG. 14 is a flow chart explanatory of a timing reproduction process.

FIG. 14 is a flow chart explanatory of a timing reproduction process, which is started up in response to detection of a note. First, a determination is made at step S91 as to whether a rest has been detected or not. If answered in the affirmative, the process goes to step S92; otherwise, the process branches to step S95. Here, the "rest" means a state where no note-on event has occurred for more than a predetermined elapsed time from a note-off event.

At step S92, a count of a phrase number (nPhrase) is incremented, followed by step S93. However, if the counted phrase number (nPhrase) is already greater than a value "NUMSERIES-1" before incrementing of the count, then the count is reset to a value "0", or if the incremented count is greater than the value "NUMSERIES-1", the count is reset to the value "0".

At next step S93, a count of an in-the-phrase position is reset to a value "0".

Step S95 is directed to an operation of sequentially changing the in-the-phrase position like "0→1→2→3→4→3→2→3→4", in the manner as explained earlier in relation to FIG. 6. The count of the in-the-phrase position is incremented by one. However, if the count of the in-the-phrase position is already greater than a value "NUMTIMINGS-1" before incrementing of the count, then the count is decremented by one. If the count is already "1" before decremented, the count is again incremented by one.

Then, a timing deviation (offset) is determined at step S96. Namely, the timing deviation (offset)=(timing data obtained by referring to the timing sequence in accordance with the phrase number and in-the-phrase position)+(timing offset assigned per player).

Next step S97 is directed to an operation for determining a timing exaggeration coefficient value $k_1$ in accordance with a performance tempo, in the manner as described above in relation to FIG. 7. Namely, a timing exaggeration coefficient value $k_1$ is determined by interpolating a tempo-vs.-timing-exaggeration-coefficient table in accordance with the current performance tempo "fTempo" (i.e., timing exaggeration coefficient value $k_1$ determined by giving the current performance tempo).

At following step S98, a timing exaggeration coefficient is determined. Namely, the timing exaggeration coefficient= (timing exaggeration coefficient value $k_1$ determined by giving the current performance tempo)*(timing exaggeration coefficient value $k_2$ assigned per player). "*" is a multiplication mark.

At following step S99, an operation is performed for obtaining ultimate note-on timing with the timing deviation and timing exaggeration coefficient having been adjusted per player. Namely, the adjusted note-on timing ("NoteOnTiming")=

NoteOnTiming+(timing deviation)*(timing exaggeration coefficient).

Namely, diversified note-on timing deviations can be imparted to each of the players by using the timing offset and timing exaggeration coefficient set per player, in addition to the timing deviations obtained from the selected timing sequence.

Whereas the arithmetic operations have been described as first adding the timing offset to the timing data given in response to the phrase number and in-the-phrase position and then multiplying the added result by the timing exaggeration coefficient, the timing data, given in response to the phrase number and in-the-phrase position, may be first multiplied and then the multiplied result may be added with the timing offset.

Further, in the above-described process, the values of the timing deviation and timing exaggeration coefficient are those values set by the performance data processing section 2 shown in FIG. 1. As the performance data to be supplied to the performance data processing section 2, there may be defined new performance data to control the timing offset for imparting a timing deviation and timing exaggeration coefficient $k_3$ for giving a timing exaggeration coefficient. Using such new performance data, the values of the timing deviation and/or timing exaggeration coefficient may be dynamically controlled in accordance with a performance input.

Namely, the timing offset controlled by the performance data is added to the timing data at step S96, and/or the timing data may be multiplied by the timing exaggeration coefficient $k_3$ controlled by the performance data.

Whereas the above-described flow chart concerns control of note-on timing, the dynamic control using such a performance input can be applied to any desired tone generator setting parameter by designating a desired note controlling parameter and tone generator setting parameter. Further, the control using such a performance input can be applied to any desired note controlling parameter by also designating a note to be controlled.

Further, the preceding paragraphs have described the example where an instrument (player) is defined for each voice. By the user designating a player after designating a desired voice (musical instrument's tone color), deviation values, presenting a different deviation state per player, are set for a predetermined note controlling parameter. If the musical instrument's tone color differs between the players, separate characters may be imparted to the players, so that different sets of deviation values optimal to the individual musical instruments (tone colors) can be set.

In some case, a same player may perform different types of musical instruments. In such a case, there may be set, in corresponding relation to the individual musical instruments (tone colors) performed by the players, modifying values corresponding to the types of musical instruments as well as deviation values of note-on timing and delay vibrato start timing defined for the individual player channels PC1–PCN.

According to specific examples of the processes described above with reference to FIGS. 12 to 14, when a given voice is allocated to a plurality of players, the user fixes the number of players to participate in a session (ensemble performance). Then, the user selects timing sequences (each including four takes) for the participating players from among the timing sequences (each including four takes) prepared for 32 players.

In an alternative, a timing sequence (each including four takes) may be selected for a particular combination of players. In this case, it is possible to impart deviation values having correlation between performances of the players exactly reflected therein.

Further, the processes have been described above with reference to FIGS. 12 to 14 as setting, as offset modifying values of player character, a timing offset and timing exaggeration coefficient per player which are to be applied to deviation values generated on the basis of a timing sequence different from those of the other players.

As a modification, the offset modifying values may be control parameters to be shared among all of the players. Namely, in this case, the user may collectively set a timing offset and timing exaggeration coefficient for each session.

Further, the preceding paragraphs have described the example where an ensemble effect is imparted to each part (voice). Alternatively, by assigning a different voice to each of the players, performance data may be processed so as to synthesize tone signals to be used for an ensemble performance by the players belonging to different parts (voices).

Furthermore, the preceding paragraphs have described the example where, in order to impart an ensemble effect, the performance data processing section 2 generates note controlling performance data and tone generator setting performance data for each of the players and outputs the thus-generated performance data to the tone generator device 3.

In an alternative, the user may set the number of player channels to "one", or the number of player channels may be fixed in advance to "one". In this case, the present invention can provide a performance data processing method, performance data processing program and performance data processing apparatus and tone signal synthesizing method which can output note controlling performance data and tone generator setting performance data for a single player that can be used to impart character to a solo performance. In this case, there can be output self-asserting performance data by imparting strong distinguishability to the character of the single player. In contrast, where an ensemble effect is to be imparted, it is preferable to weaken the respective character of the players.

Whereas the performance data to be processed by the present invention have been considered on the assumption that they exactly agree with a musical score, such assumption is not always essential. Irrespective of the nature of the performance data, the present invention can appropriately impart an ensemble feeling and characteristic or unique expression.

Further, it should be appreciated that the performance data to be processed by the present invention are not limited to performance data for use in an electronic musical instrument; the performance data may be of performance data for a personal computer having a tone generator incorporated therein, Karaoke apparatus, game apparatus, portable communication terminal, such as a portable phone, having a ringer melody (incoming-call signaling melody) tone generator, etc. Where the performance data are to be processed via a personal computer or portable communication terminal connected to a communication network, the application of the present invention is not limited to the case where the performance data processing functions of the present invention are performed by the terminal alone; for example, the functions of the present invention may be performed as a whole via a network system composed of terminals and server, by causing part of the performance data processing functions of the present invention to be performed by the server.

In summary, the present invention arranged in the above-described manner can advantageously generate, in accordance with only simple settings, performance data to be suitably used to synthesize tone signals having a realistic ensemble feeling based on different character or individuality of players. Further, the present invention can generate, for each of the players, performance data to be suitably used to synthesize tone signals having characteristic or unique expression.

The present invention relates to the subject matter of Japanese Patent Application No. 2002-231559 filed on Aug. 8, 2002, the disclosure of which is expressly incorporated herein by reference in its entirety.

What is claimed is:

1. A performance data processing method comprising:

a step of receiving a series of performance data;

a detection step of detecting a predetermined type of note controlling performance data from among the series of performance data received by said step of receiving, the predetermined type of note controlling performance data including a control value of a predetermined tone characteristic of a note;

a setting step of, each time the predetermined type of note controlling performance data is detected, setting deviation values for a plurality of channels presenting mutually different deviation states, in order to cause the control value of the predetermined tone characteristic of the note to vary each time the predetermined type of note controlling performance data is detected; and a generation step of, each time the predetermined type of note controlling performance data is detected, causing the control value of the predetermined tone characteristic of the note, included in the detected predetermined type of note controlling performance data, to vary among the plurality of channels in accordance with respective ones of the deviation values of the channels, set by said setting step, so as to obtain channel-specific control values, and generating, for individual ones of the channels, the channel-specific control values as new control values of the predetermined tone characteristic of the note, wherein note controlling performance data of the predetermined type having the new control values of the predetermined tone characteristic of the note, generated by said generation step, are created for the plurality of channels.

2. A performance data processing method as claimed in claim 1 wherein the predetermined tone characteristic of the note is note-on timing to start tone generation of the note.

3. A performance data processing method as claimed in claim 1 wherein the predetermined tone characteristic of the note is delay vibrato start timing.

4. A performance data processing method as claimed in claim 1 wherein the series of performance data and the note controlling performance data of the predetermined type created for the plurality of channels are performance data accompanied by timing data.

5. A performance data processing method as claimed in claim 1 wherein the deviation values for the plurality of channels are values created on the basis of a characteristic pattern of deviations of the predetermined tone characteristic of the note analyzed when a same musical score was actually performed simultaneously by a plurality of players equal in number to the channels.

6. A performance data processing method as claimed in claim 1 which further comprises a number-of-channel designation step of designating a desired number N of the channels, and wherein said setting step selects deviation values from storage means storing deviation values for a plurality of channels presenting mutually different deviation states and sets the selected deviation values for the N channels.

7. A performance data processing method as claimed in 6 wherein the storage section stores, for each of a plurality of channels, deviation values of a predetermined type of tone characteristic in association with a plurality of types of note controlling performance data, said detection step is directed to detecting any one of the plurality of types of note controlling performance data, and said setting step selects from the storage means the deviation values, for a plurality of channels, of the predetermined tone characteristic corresponding to the type of note controlling performance data detected by said detection step and thereby sets the deviation values, for the plurality of channels, of the predetermined tone characteristic.

8. A performance data processing method as claimed in claim 1 wherein said setting step includes a step of further adjusting the set deviation value separately for each of the channels so that the adjusted deviation value of each of the channels is used by said generation step.

9. A performance data processing method as claimed in claim 1 wherein, in order to cause a control value of another predetermined tone characteristic of the note to vary each time the predetermined type of note controlling performance data is detected, said setting step further sets other deviation values for the plurality of channels, presenting mutually different deviation states, each time the predetermined type of note controlling performance data is detected, wherein, each time the predetermined type of note controlling performance data is detected, said generation step causes the control value of the other predetermined tone characteristic of the note, included in the predetermined type of note controlling performance data created for each of the plurality of channels, to vary among the plurality of channels in accordance with a corresponding one of the other deviation values of the channels, further set by said setting step, so as to obtain channel-specific control values of the other predetermined tone characteristic, and thereby further generates the channel-specific control values as new control values of the other predetermined tone characteristic of the note for the individual channels, and wherein note controlling performance data of the predetermined type having, in addition to the new control values of the predetermined tone characteristic of the note, the new control values of the other predetermined tone characteristic of the note, further generated by said generation step, are created for the plurality of channels.

10. A performance data processing method comprising:

a step of receiving a series of performance data;

a detection step of detecting a predetermined type of tone generator setting performance data from among the series of performance data received by said step of receiving, the predetermined type of tone generator setting performance data including a tone generator setting value;

a setting step of, each time the predetermined type of tone generator setting performance data is detected, setting deviation values for a plurality of channels presenting mutually different deviation states; and a generation step of, each time the predetermined type of tone generator setting performance data is detected, causing the original tone generator setting value, included in the detected predetermined type of tone generator setting performance data, to vary among the plurality of channels in accordance with respective ones of the deviation values of the channels set by said setting step so as to obtain channel-specific tone generator setting values, and generating, for individual ones of the channels, the channel-specific tone generator setting values as new tone generator setting values, wherein tone generator setting performance data of the predetermined type having the new tone generator setting values, generated by said generation step, are created for the plurality of channels.

11. A performance data processing method as claimed in claim 10 wherein, in order to cause the original tone generator setting value to vary each time the predetermined type of tone generator setting performance data is detected, said setting step includes a step of setting deviation values for the plurality of channels, presenting mutually different deviation states, each time the predetermined type of tone generator setting performance data is detected.

12. A computer program including a group of instructions to cause a computer to perform a performance data processing method, said performance data processing method comprising:

a step of receiving a series of performance data;

a detection step of detecting a predetermined type of note controlling performance data from among the series of performance data received by said step of receiving, the predetermined type of note controlling performance data including a control value of a predetermined tone characteristic of a note;

a setting step of, each time the predetermined type of note controlling performance data is detected, setting deviation values for a plurality of channels presenting mutually different deviation states, in order to cause the control value of the predetermined tone characteristic of the note to vary each time the predetermined type of note controlling performance data is detected; and a generation step of, each time the predetermined type of note controlling performance data is detected, causing the control value of the predetermined tone characteristic of the note, included in the detected predetermined type of note controlling performance data, to vary among the plurality of channels in accordance with respective ones of the deviation values of the channels set by said setting step so as to obtain channel-specific control values, and generating, for individual ones of the channels, the channel-specific control values as new control values of the predetermined tone characteristic, wherein note controlling performance data of the predetermined type having the new control values of the predetermined tone characteristic of the note, generated by said generation step, are created for the plurality of channels.

13. A performance data processing apparatus comprising:

a receiving section that receives a series of performance data;

a detection section that detects a predetermined type of note controlling performance data from among the series of performance data received by said receiving section, the predetermined type of note controlling performance data including a control value of a predetermined tone characteristic of a note;

a setting section that, each time the predetermined type of note controlling performance data is detected, sets deviation values for a plurality of channels presenting mutually different deviation states, in order to cause the control value of the predetermined tone characteristic of the note to vary each time the predetermined type of note controlling performance data is detected; and a generation section that, each time the predetermined type of note controlling performance data is detected, causes the control value of the predetermined tone characteristic of the note, included in the detected predetermined type of note controlling performance data, to vary among the plurality of channels in accordance with respective ones of the deviation values of the channels set by said setting section so as to obtain channel-specific control values, and generates, for individual ones of the channels, the channel-specific control values as new control values of the predetermined tone characteristic of the note, wherein note controlling performance data of the predetermined type having the new control values of the predetermined tone characteristic of the note, generated by said generation section, are created for the plurality of channels.

14. A tone signal synthesizing method comprising:

a step of receiving a series of performance data;

a detection step of detecting a predetermined type of note controlling performance data from among the series of performance data received by said step of receiving, the predetermined type of note controlling performance data including a control value of a predetermined tone characteristic of a note;

a setting step of, each time the predetermined type of note controlling performance data is detected, setting deviation values for a plurality of channels presenting mutually different deviation states, in order to cause the control value of the predetermined tone characteristic of the note to vary each time the predetermined type of note controlling performance data is detected;

a generation step of, each time the predetermined type of note controlling performance data is detected, causing the control value of the predetermined tone characteristic of the note, included in the detected predetermined type of note controlling performance data, to vary among the plurality of channels in accordance with respective ones of the deviation values of the channels set by said setting step so as to obtain channel-specific control values, and generating, for individual ones of the channels, the channel-specific control values as new control values of the predetermined tone characteristic of the note; and a tone synthesis step of synthesizing tone signals for the plurality of channels in accordance with note controlling performance data of the predetermined type having the new control values of the predetermined tone characteristic of the note generated by said generation step.

15. A performance data processing method comprising:

a step of receiving a series of performance data;

a detection step of detecting a predetermined type of note controlling performance data from among the series of performance data received by said step of receiving, the predetermined type of note controlling performance data including a control value of a predetermined tone characteristic of a note;

a phrase detection step of detecting a break in a phrase within the series of performance data;

a setting step of, each time the predetermined type of note controlling performance data is detected, setting a deviation value for at least one channel, in order to cause the control value of the predetermined tone characteristic of the note to vary each time the predetermined type of note controlling performance data is detected, said setting step setting the deviation value such that a deviation state of the deviation value of the at least one channel is varied each time a break in a phrase within the series of performance data is detected; and a generation step of, each time the predetermined type of note controlling performance data is detected, causing the control value of the predetermined tone characteristic of the note, included in the detected predetermined type of note controlling performance data, to vary in accordance with the deviation value of the at least one channel set by said setting step so as to obtain a varied control value, and generating the varied control value as a new control value of the predetermined tone characteristic of the note, wherein note controlling performance data of the predetermined type having the new control value of the predetermined tone characteristic of the note, generated by said generation step, is created for at least one channel.

16. A performance data processing method as claimed in claim 15 wherein said phrase detection step detects a break in a phrase within the series of performance data by detecting a break in a train of notes within the series of performance data.

17. A performance data processing method as claimed in claim 15 wherein the predetermined tone characteristic of the note is note-on timing to start tone generation of the note.

18. A performance data processing method as claimed in claim 15 wherein the series of performance data and the note controlling performance data of the predetermined type created for at least one channel are performance data accompanied by timing data.

19. A performance data processing method as claimed in claim 15 wherein the deviation value for the at least one channel is a value created on the basis of a characteristic pattern of deviation of the predetermined tone characteristic of the note analyzed when a same musical score was actually performed by at least one player.

20. A performance data processing method as claimed in claim 15 wherein said setting step designates, from storage means storing for at least one channel a series of deviation values indicative of a deviation state, an initial value in the series of deviation values of the at least one channel each time a break in a phrase within the series of performance data is detected and reads out, in accordance with predetermined order, one of the deviation values of the at least one channel starting with the designated initial value each time the predetermined type of note controlling performance data is detected, to thereby set the deviation value for the at least one channel.

21. A performance data processing method as claimed in claim 20 wherein said setting step performs an arithmetic operation on the deviation value of the at least one channel, read out from the storage means, to vary the deviation state each time a break in a phrase within the series of performance data is detected.

22. A performance data processing method as claimed in claim 20 wherein said storage means stores a plurality of series of deviation values for a plurality of channels presenting mutually different deviation states, and wherein said setting step selects the series of deviation values of at least one channel from said storage means, to thereby set the deviation value.

23. A performance data processing method as claimed in claim 22 which further comprises a characteristic pattern detection step of detecting, for each performance section divided by the break in the phrase, a characteristic pattern of a train of notes included in the performance data within the performance section, and wherein said setting step selects, in accordance with the characteristic pattern detected by said characteristic pattern detection step, a series of deviation values of at least one of the channels which is suitable for the detected characteristic pattern.

24. A performance data processing method as claimed in claim 20 wherein, each time the predetermined type of note controlling performance data is detected, said setting step reads out one of the deviation values in the series of deviation values for the at least one channel first in accordance with predetermined order where deviation value readout is executed first in a forward direction and then in a reverse direction and then the deviation value readout in the forward direction and reverse direction is repeated.

25. A performance data processing method as claimed in claim 20 wherein the storage section stores, for at least one channel, deviation values of a predetermined type of tone characteristic in association with a plurality of types of note controlling performance data, and said setting step selects from the storage means the deviation values, for at least one channel, of the predetermined tone characteristic in accordance with the type of note controlling performance data and thereby sets the deviation value, for the at least one channel, of the predetermined tone characteristic.

26. A performance data processing method as claimed in claim 15 wherein said setting step designates, from storage means storing for at least one channel a plurality of series of deviation values indicative of mutually different deviation states, any one of the plurality of series of deviation values for the at least one channel each time a break in a phrase within the series of performance data is detected and reads out in order the deviation values of the designated series of deviation values each time the predetermined type of note controlling performance data is detected, to thereby set the deviation value for the at least one channel.

27. A performance data processing method as claimed in claim 15 wherein said setting step includes a step of further adjusting the set deviation value for at least one channel so that the adjusted deviation value is used by said generation step.

28. A performance data processing method comprising:

a step of receiving a series of performance data;

a detection step of detecting a predetermined type of tone generator setting performance data from among the series of performance data received by said step of receiving, the predetermined type of tone generator setting performance data including a tone generator setting value;

a phrase detection step of detecting a break in a phrase within the series of performance data;

a setting step of setting a deviation value for at least one channel to cause the original tone generator setting value to vary each time the predetermined type of tone generator setting performance data is detected or each time a break in a phrase within the series of performance data is detected; and a generation step of, each time the predetermined type of tone generator setting performance data is detected, causing the original tone generator setting value, included in the detected predetermined type of tone generator setting performance data, to vary in accordance with the deviation value of at least one channel set by said setting step so as to obtain a varied tone generator setting value and generating the varied tone generator setting value as a new tone generator setting value, said generation step being also arranged to, each time a break in a phrase within the series of performance data is detected, cause the tone generator setting value, included in the predetermined type of tone generator setting performance data last detected by said detection step, to vary in accordance with the deviation value of the at least one channel set by said setting step so as to obtain a varied tone generator setting value and then generate the varied tone generator setting value as a new tone generator setting value, wherein tone generator setting performance data of the predetermined type having the new tone generator setting value, generated by said generation step, is created for the at least one channel.

29. A computer program including a group of instructions to cause a computer to perform a performance data processing method, said performance data processing method comprising:

a step of receiving a series of performance data;

a detection step of detecting a predetermined type of note controlling performance data from among the series of performance data received by said step of receiving, the predetermined type of note controlling performance data including a control value of a predetermined tone characteristic of a note;

a phrase detection step of detecting a break in a phrase within the series of performance data;

a setting step of, each time the predetermined type of note controlling performance data is detected, setting a deviation value for at least one channel, in order to cause the control value of the predetermined tone characteristic of the note to vary each time the predetermined type of note controlling performance data is detected, said setting step setting the deviation value such that a deviation state of the deviation value of the at least one channel is varied each time a break in a phrase within the series of performance data is detected; and a generation step of, each time the predetermined type of note controlling performance data is detected, causing the control value of the predetermined tone characteristic of the note, included in the detected predetermined type of note controlling performance data, to vary in accordance with the deviation value of the at least one channel set by said setting step so as to obtain a varied control value, and generating the varied control value as a new control value of the predetermined tone characteristic of the note, wherein note controlling performance data of the predetermined type having the new control values of the predetermined tone characteristic of the note, generated by said generation step, is created for at least one channel.

30. A performance data processing apparatus comprising:

a receiving section that receives a series of performance data;

a detection section that detects a predetermined type of note controlling performance data from among the series of performance data received by said receiving section, the predetermined type of note controlling performance data including a control value of a predetermined tone characteristic of a note;

a phrase detection section that detects a break in a phrase within the series of performance data;

a setting section that, each time the predetermined type of note controlling performance data is detected, sets a deviation value for at least one channel, in order to cause the control value of the predetermined tone characteristic of the note to vary each time the predetermined type of note controlling performance data is detected, said setting section setting the deviation value such that a deviation state of the deviation value of the at least one channel is varied each time a break in a phrase within the series of performance data is detected; and a generation section that, each time the predetermined type of note controlling performance data is detected, causes the control value of the predetermined tone characteristic of the note, included in the detected predetermined type of note controlling performance data, to vary in accordance with the deviation value of the at least one channel set by said setting section so as to obtain a varied control value, and generates the varied control value as a new control value of the predetermined tone characteristic of the note, wherein note controlling performance data of the predetermined type having the new control values of the predetermined tone characteristic of the note, generated by said generation means, is created for at least one channel.

31. A tone signal synthesis method comprising:

a step of receiving a series of performance data;

a detection step of detecting a predetermined type of note controlling performance data from among the series of performance data received by said step of receiving, the predetermined type of note controlling performance data including a control value of a predetermined tone characteristic of a note;

a phrase detection step of detecting a break in a phrase within the series of performance data;

a setting step of, each time the predetermined type of note controlling performance data is detected, setting a deviation value for at least one channel, in order to cause the control value of the predetermined tone characteristic of the note to vary each time the predetermined type of note controlling performance data is detected, said setting step setting the deviation value such that a deviation state of the deviation value of the at least one channel is varied each time a break in a phrase within the series of performance data is detected;

a generation step of, each time the predetermined type of note controlling performance data is detected, causing the control value of the predetermined tone characteristic of the note, included in the detected predetermined type of note controlling performance data, to vary in accordance with the deviation value of the at least one channel set by said setting step so as to obtain a varied control value, and generating the varied control value as a new control value of the predetermined tone characteristic of the note; and a tone synthesis step of synthesizing a tone signal for the at least one channel in accordance with note controlling performance data of the predetermined type having the new control values of the predetermined tone characteristic of the note generated by said generation step.

* * * * *